US011672400B2

(12) United States Patent
Beverley

(10) Patent No.: US 11,672,400 B2
(45) Date of Patent: Jun. 13, 2023

(54) WATER-FED SURFACE CLEANING DEVICE, SYSTEM, AND METHOD

(71) Applicant: Anthony Beverley, Magna, UT (US)

(72) Inventor: Anthony Beverley, Magna, UT (US)

( * ) Notice: Subject to any disclaimer, the term of this patent is extended or adjusted under 35 U.S.C. 154(b) by 41 days.

(21) Appl. No.: 16/953,200

(22) Filed: Nov. 19, 2020

(65) Prior Publication Data

US 2022/0151452 A1 May 19, 2022

(51) Int. Cl.
*A47L 13/22* (2006.01)
*A47L 13/42* (2006.01)

(52) U.S. Cl.
CPC ..... *A47L 13/22* (2013.01); *A47L 13/42* (2013.01)

(58) Field of Classification Search
CPC ..... A47L 13/20; A47L 13/22; A47L 13/23; A47L 13/24; A47L 13/254; A47L 13/256; A47L 13/26; A47L 13/42; A47L 11/08; A47L 11/26; A47L 11/34; A47L 11/408; A47L 11/4083; A47L 11/4088; A46B 11/06; A46B 11/066; F16L 3/00; B05B 3/18; B05B 15/62
USPC ..... 15/77, 118, 228, 244.2; 401/47, 268, 401/285; 285/61
See application file for complete search history.

(56) References Cited

U.S. PATENT DOCUMENTS

| | | | | |
|---|---|---|---|---|
| 2,521,929 A * | 9/1950 | McNeill, Jr. | A46B 11/063 401/46 |
| 4,008,968 A * | 2/1977 | Hobbs | A47L 17/00 401/196 |
| 6,889,917 B2 * | 5/2005 | Fahy | A47L 13/24 239/525 |
| 7,004,663 B1 * | 2/2006 | Cupidon-Ebanks | A47L 13/22 401/278 |
| 2016/0331203 A1 * | 11/2016 | Tait | A46B 11/06 |

* cited by examiner

*Primary Examiner* — Laura C Guidotti
*Assistant Examiner* — Sidney D Hohl

(57) ABSTRACT

The disclosure relates to a cleaning device for cleaning a surface. The cleaning device includes a plate that holds a cleaning material, a rinse bar attached to the plate and disposed to extend along two or more edges of the plate, and one or more rinse inlet ports that are connected to the rinse bar and are in fluid communication with the rinse bar. A plurality of openings are formed in the rinse bar and fluid supplied to the rinse bar is expelled out of the plurality of openings of the rinse bar.

9 Claims, 18 Drawing Sheets

WATER-FED SURFACE CLEANING DEVICE, SYSTEM, AND METHOD

TECHNICAL FIELD

The disclosure relates generally to surface cleaning using water-fed/fluid-fed devices for the scrubbing, brushing, cleaning, and/or polishing of surfaces such as windows.

BACKGROUND

Several different cleaning implements have been created for cleaning and scrubbing surfaces, such as floors, walls, and windows. It is often true that operators of such cleaning implements may need to operate such implements at very large distances. For example, professional window cleaners often stand on ground floor and operate a window cleaning brush on a very long extendable pole in order to clean windows that are at ground level or that are two, three, four, or more stories above ground level.

Operating cleaning implements in a variety of different situations (e.g., such as cleaning windows at large distances and heights or in different indoor and outdoor environments and conditions) may increase difficulty in adequately cleaning windows or other surfaces. Lack of maneuverability and lack of cleaning configurations and setups in current cleaning implements make it difficult and uncomfortable for professional cleaners to adequately clean a surface or window in a variety of different situations.

Furthermore, current cleaning implements limit options (e.g., direction of cleaning, beginning of cleaning a window, and ending of cleaning a window) for how a professional window cleaner may clean a window without leaving behind residue or excess water/cleaning solution that may cause streaks on a window.

Accordingly, there exists a need within the known cleaning art to improve functionality, maneuverability, versatility, and operability of cleaning implements, as well as increase comfort and cleaning options for operators using cleaning implements (e.g, water-fed window cleaning devices). It is generally desirable in the fields of window and surface cleaning to improve comfort, maneuverability, and cleaning options/ability for cleaning devices and cleaning professionals. Therefore, it is desirable to develop surface cleaning devices, systems, and methods that allow for improved surface cleaning and device usability for cleaning professionals.

BRIEF DESCRIPTION OF THE DRAWINGS

Non-limiting and non-exhaustive implementations of the disclosure are described with reference to the following figures, wherein like reference numerals refer to like parts throughout the various views unless otherwise specified. Advantages of the disclosure will become better understood with regard to the following description and accompanying drawings where.

DETAILED DESCRIPTION

Figure 1:
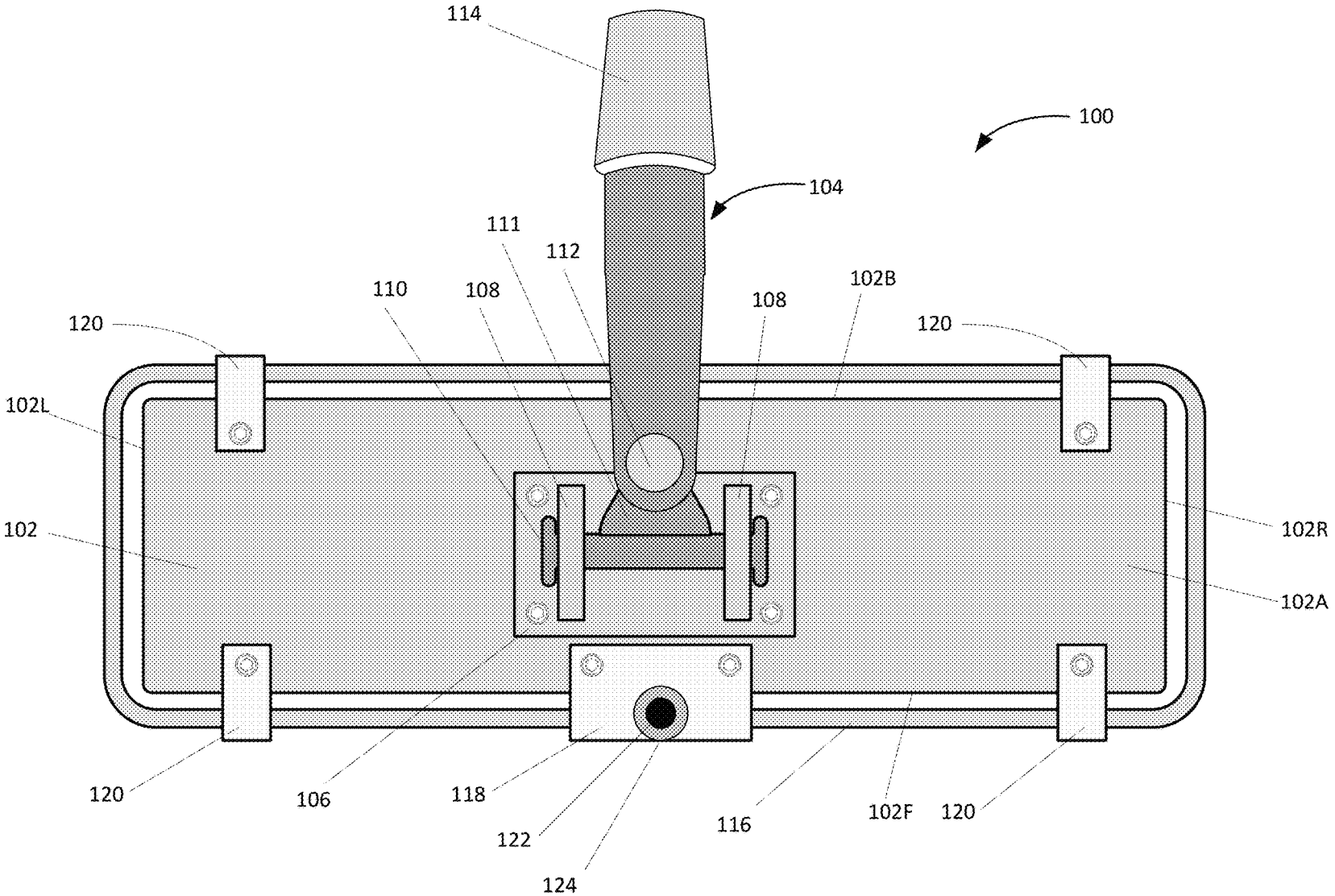
FIG. 1 illustrates a top view of an exemplary cleaning device according to at least one embodiment.

Disclosed herein are devices and systems used for cleaning surfaces (e.g., windows). An embodiment of the disclosure is a cleaning system for cleaning surfaces, such as windows, with a cleaning device. Such systems and devices disclosed herein provide for cleaning of surfaces such as windows, floors, walls, ceilings, roofs, solar panels, or the like. The systems and devices disclosed herein offer increased functionality, maneuverability, versatility, and operability of cleaning devices and increased comfort for users of cleaning devices. Embodiments of systems and devices described herein additionally offer new configurations and options for cleaning devices used for cleaning surfaces. The increased functionality, maneuverability, versatility, operability, and new configurations and options for cleaning devices also lead to better cleaning of windows and surfaces cleaned by the systems and devices described herein.

Although the examples and embodiments described herein are discussed specifically with regard to window cleaning, it is to be appreciated, as described above, that the examples and embodiments may be applied to cleaning of any surface or object (e.g., windows, floors, walls, ceilings, roofs, solar panels, or the like). Thus, while many portions of this specification are directed to the specific application of window cleaning, the cleaning systems and devices described herein are advantageous and useful to any cleaning application and the cleaning of any surface.

An embodiment of the disclosure is a cleaning device for cleaning a surface, the cleaning device comprising a plate that holds a cleaning material, a rinse bar attached to the plate and disposed to extend along two or more edges of the plate, and one or more rinse inlet ports that are connected to the rinse bar and are in fluid communication with the rinse bar. In an embodiment a plurality of openings are formed in the rinse bar and fluid supplied to the rinse bar is expelled out of the plurality of openings.

In an embodiment, the rinse bar extends around the entire outer perimeter of the plate. In an embodiment, the rinse bar is attached to the plate by a plurality of supporting brackets. In an embodiment, one or more of the plurality of supporting brackets is in fluid communication with the rinse bar, and one or more of the rinse inlet ports is connected to the one or more supporting brackets in fluid communication with the rinse bar and the one or more of the rinse inlet ports is in fluid communication with the rinse bar through the one or more supporting brackets.

In an embodiment, the cleaning device further comprises a handle attached to a first surface of the plate. In an embodiment, the handle comprises a connector that connects a pole to the cleaning device. In an embodiment, the handle further comprises a first pivot that allows the plate to pivot with respect to the handle in a first direction, and a second pivot that allows the plate to pivot with respect to the handle in a second direction that is perpendicular to the first direction.

In an embodiment the handle further comprises one or more locking mechanisms for locking one or more of the first pivot and the second pivot to prevent rotation of the plate with respect to the handle in one or more of the first direction and the second direction.

In an embodiment, the cleaning device further comprises one or more holes formed through the plate, and one or more fluid inlet ports connected to a first surface of the plate at positions adjacent to the one or more holes. In an embodiment the cleaning material is disposed on a second surface of the plate that is opposite to the first surface of the plate and fluid supplied to the one or more fluid inlet ports passes through the plate and is expelled out of the holes to a second surface of the plate.

In an embodiment, the one or more rinse inlet ports are removably connected to the rinse bar and the one or more fluid inlet ports are removably connected to the plate such that worn rinse inlet ports inlet and worn fluid inlet ports may be removed and replaced with new rinse inlet ports and new fluid inlet ports.

In an embodiment, the cleaning material is removably held to the plate such that a worn cleaning material may be removed from the plate and replaced with a new cleaning material. In an embodiment, the fluid supplied to the one or more rinse inlet ports is a first fluid and the fluid supplied to the one or more inlet ports is a second fluid different than the first fluid.

An embodiment of the disclosure is a cleaning system for cleaning surfaces, the cleaning system comprising device comprising a plate that holds a cleaning material, a rinse bar attached to the plate and disposed to extend along two or more edges of the plate, and one or more rinse inlet ports that are connected to the rinse bar and are in fluid communication with the rinse bar. In an embodiment, the cleaning system further comprises a fluid-fed pole removably connected to the cleaning device, a fluid feed system that supplies fluid to the cleaning device, and rinse tubing that is removably connected to the one or more rinse inlet ports and that carries fluid from the fluid feed system to the one or more rinse inlet ports of the cleaning device. In an embodiment a plurality of openings are formed in the rinse bar and fluid supplied to the rinse bar is expelled out of the plurality of openings.

In an embodiment, the rinse bar extends around the entire outer perimeter of the plate. In an embodiment, the rinse bar is attached to the plate by a plurality of supporting brackets. In an embodiment, one or more of the plurality of supporting brackets is in fluid communication with the rinse bar, and one or more of the rinse inlet ports is connected to the one or more supporting brackets in fluid communication with the rinse bar and the one or more of the rinse inlet ports is in fluid communication with the rinse bar through the one or more supporting brackets.

In an embodiment, the cleaning device further comprises a handle attached to a first surface of the plate. In an embodiment, the handle comprises a connector that connects a pole to the cleaning device. In an embodiment, the handle further comprises a first pivot that allows the plate to pivot with respect to the handle in a first direction, and a second pivot that allows the plate to pivot with respect to the handle in a second direction that is perpendicular to the first direction.

In an embodiment, the cleaning device further comprises one or more holes formed through the plate, and one or more fluid inlet ports connected to a first surface of the plate at positions adjacent to the one or more holes. In an embodiment, the system further comprises fluid tubing that is removably connected to the one or more fluid inlet ports and that carries fluid from the fluid feed system to the one or more fluid inlet ports of the cleaning device. In an embodiment the cleaning material is disposed on a second surface of the plate that is opposite to the first surface of the plate and fluid supplied to the one or more fluid inlet ports passes through the plate and is expelled out of the holes to a second surface of the plate.

In an embodiment, the one or more rinse inlet ports are removably connected to the rinse bar and the one or more fluid inlet ports are removably connected to the plate such that worn rinse inlet ports inlet and worn fluid inlet ports may be removed and replaced with new rinse inlet ports and new fluid inlet ports.

In an embodiment, the cleaning material is removably held to the plate such that a worn cleaning material may be removed from the plate and replaced with a new cleaning material. In an embodiment, the fluid supplied to the one or more rinse inlet ports is a first fluid and the fluid supplied to the one or more inlet ports is a second fluid different than the first fluid.

For the purposes of promoting an understanding of the principles in accordance with the disclosure, reference will now be made to the embodiments illustrated in the drawings and specific language will be used to describe the same. It will nevertheless be understood that no limitation of the scope of the disclosure is thereby intended. Any alterations and further modifications of the inventive features illustrated herein, and any additional applications of the principles of the disclosure as illustrated herein, which would normally occur to one skilled in the relevant art and having possession of this disclosure, are to be considered within the scope of the disclosure claimed.

Before the structure, systems, devices, and methods for cleaning of surfaces are disclosed and described, it is to be understood that this disclosure is not limited to the particular structures, configurations, process steps, and materials disclosed herein as such structures, configurations, process steps, and materials may vary somewhat. It is also to be understood that the terminology employed herein is used for the purpose of describing particular embodiments only and is not intended to be limiting since the scope of the disclosure will be limited only by the appended claims and equivalents thereof.

In describing and claiming the subject matter of the disclosure, the following terminology will be used in accordance with the definitions set out below.

It must be noted that, as used in this specification and the appended claims, the singular forms "a," "an," and "the" include plural referents unless the context clearly dictates otherwise.

As used herein, the terms "comprising," "including," "containing," "characterized by," and grammatical equivalents thereof are inclusive or open-ended terms that do not exclude additional, unrecited elements or method steps.

As used herein, the phrase "consisting of" and grammatical equivalents thereof exclude any element or step not specified in the claim.

As used herein, the phrase "consisting essentially of" and grammatical equivalents thereof limit the scope of a claim to the specified materials or steps and those that do not materially affect the basic and novel characteristic or characteristics of the claimed disclosure.

A detailed description of systems and methods consistent with embodiments of the disclosure is provided below. While several embodiments are described, it should be understood that this disclosure is not limited to any one embodiment, but instead encompasses numerous alternatives, modifications, and equivalents. In addition, while numerous specific details are set forth in the following description to provide a thorough understanding of the embodiments disclosed herein, some embodiments may be practiced without some or all these details. Moreover, for the purpose of clarity, certain technical material that is known in the related art has not been described in detail in order to avoid unnecessarily obscuring the disclosure.

Turning to the figures, FIG. 1 illustrates a cleaning device 100. As shown, cleaning device 100 may include a plate 102. The surface of plate 102 that is facing out in FIG. 1 is a top surface 102A of plate 102. As shown in FIG. 1, a handle 104 may be attached to top surface 102A of plate 102 via an attachment base 106 of handle 104. The method of attaching handle 104 (via attachment base 106) to top surface 102A of plate 102 is not particularly limited and may include using fasteners, rivets, screws, adhesive, brackets, locking mechanisms, and or any other suitable method of attachment.

Handle 104 may be configured to allow plate 102 to be maneuvered in multiple directions. As shown handle 104 may include first supports 108 and pin 110 that is inserted through holes formed in first supports 108 to allow plate 102 to pivot in a first direction (e.g., vertical direction) relative to handle 104. Handle 104 may include a second support 111, which is fixed to pin 110, and a pin 112 inserted through handle 104 and a hole in the second support to allow plate 102 to pivot in a second direction (e.g., horizontal direction) relative to handle 104. First supports 108 combined with pin 110 may be described as a first pivot and second support 111 combined with pin 112 may be described as a second pivot. The rotation and maneuverability of plate 102 with respect to handle 104 will be described in further detail below in the discussion of FIGS. 6A and 6B.

Handle may further include connector 114 for connecting cleaning device 100 to a pole for extending a reach of cleaning device 100. Connector 114 may be any suitable connector for attaching a pole to cleaning device 100. For example, connector 114 may be a threaded female connector that receives a threaded male end of a pole. The threads may be American thread, European thread, or any other known form of threading. Alternatively, connector 114 may be a twist-and-lock style connector, a push connector, or any other form of connector suitable for connecting a pole to cleaning device 100.

As illustrated in FIG. 1, cleaning device 100 may further include a rinse bar 116. Rinse bar 116 is a hollow tubular member used to deliver a cleaning fluid (e.g., water, purified water, low/zero TDS "total dissolved solids" water) to a cleaning surface. The rinse bar 116 is attached to plate 102 via main bracket 118 that holds rinse bar 116 within and is fastened to plate 102.

For cleaning a surface, the rinse bar 116 may be supplied with water that has been purified, processed, and/or filtered in such a way that the total dissolved solids ("TDS") in the water is very low parts per million ("ppm") or at zero. Water having very low or zero ppm TDS will dry with minimal streaking and residue left behind, leaving clean surfaces and windows without excessive or undesirable spotting after cleaning. While zero TDS water is preferable for use in the rinse bar to prevent spotting and mineral buildup in the device and to ensure the surfaces are left clean with low or no streaks and/or residue left behind after cleaning, the disclosure is not limited to using only this fluid. Any TDS level of water may be used or any other cleaning fluid suitable for rinsing and cleaning is to be understood to be within the scope of this disclosure.

Figure 2:
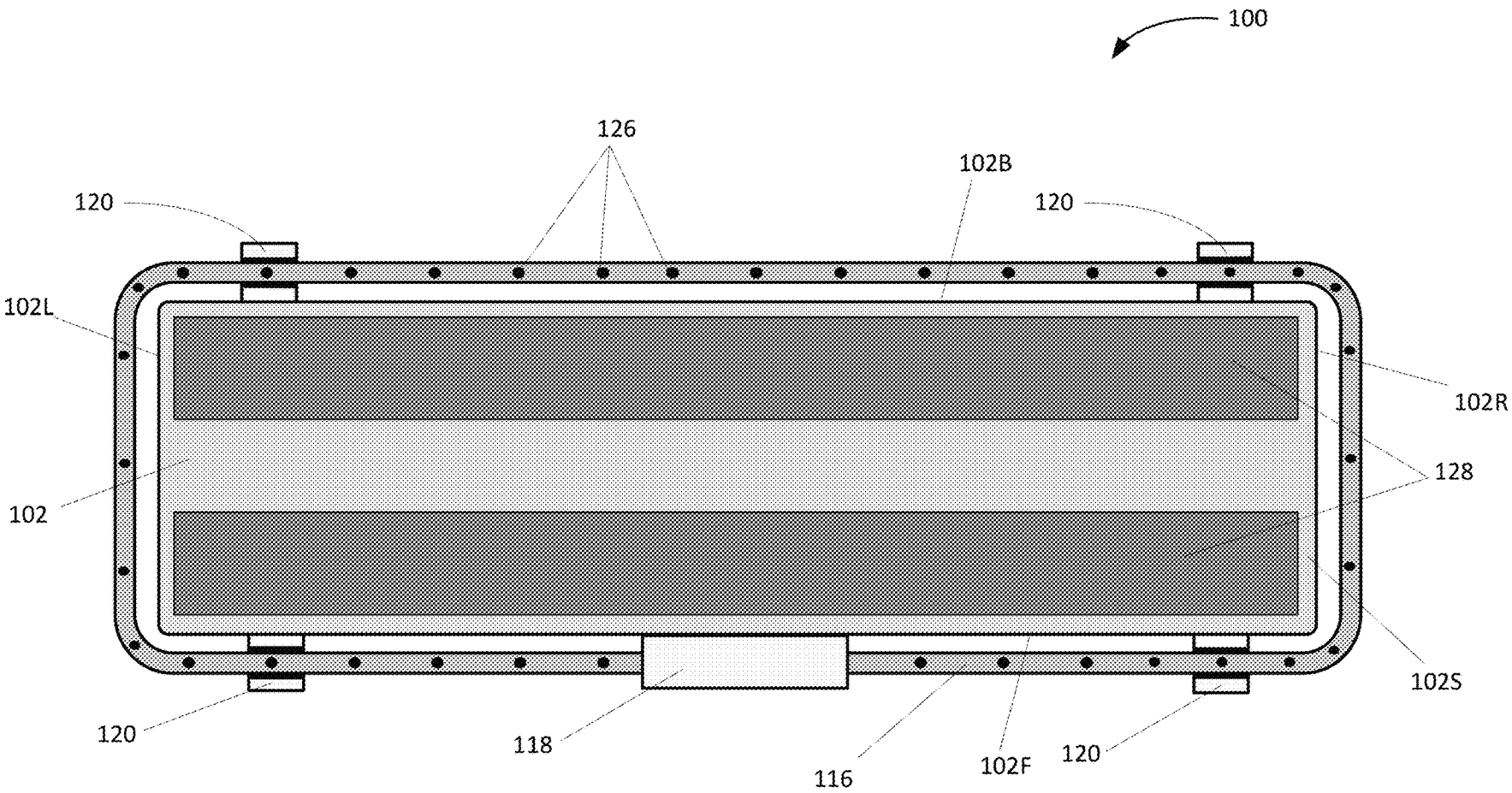
FIG. 2 illustrates a bottom view of the exemplary cleaning device according to at least one embodiment.

Rinse bar 116 may be additionally supported and/or attached to plate 102 by a plurality of supporting brackets 120. As shown in FIGS. 1 and 2, supporting brackets 120 are disposed in various places around plate 102 to provide support and stability to rinse bar 116. The method of attaching main bracket 118 and supporting brackets 120 to plate 102 is not particularly limited and may include using fasteners, rivets, screws, adhesive, brackets, locking mechanisms, and or any other suitable method of attachment.

FIGS. 1 and 2 further show that rinse bar 116 may extend along one or more edges of plate 102. As illustrated, rinse bar 116 extends around an entire outer perimeter of plate 102 and extends along all edges of plate 102 including left edge 102L, right edge 102R, front edge 102F, and back edge 102B.

Main bracket 118 may include a fluid opening 122 and a rinse inlet port 124 attached at the site of fluid opening 122. Rinse inlet port 124 may be in fluid communication with fluid opening 122, main bracket 118, and rinse bar 116 in order to supply fluid to the rinse bar. Fluid communication between rinse inlet port 124, fluid opening 122, main bracket 118, and rinse bar 116 will be discussed in further detail below in the discussion of FIG. 5.

Further features of cleaning device 100 are illustrated in FIG. 2, which is a bottom view of cleaning device 100. As shown in FIG. 2, rinse bar 116 has a number of holes 126 formed in rinse bar 116. Fluid supplied to rinse bar 116 through rinse inlet port 124 flows throughout an entire length of rinse bar 116 and exits in a spray out of holes 126. When cleaning device 100 is in use, fluid exiting holes 126 is sprayed on a surface being cleaned to aid in the cleaning of said surface.

The brackets (e.g., main bracket 118 and supporting brackets 120) may be configured in different ways to facilitate the spray of fluid out of holes 126. For example, FIG. 2 shows that main bracket 118 may wrap around a bottom of rinse bar 116 to hold and support rinse bar 116 in place around plate 102. FIG. 2 further shows that supporting brackets 120 may be configured to support rinse bar 116 in a way that leaves a portion of rinse bar 116 open in order to leave certain holes 126 in rinse bar 116 open to spray cleaning fluid to ensure consistent spray from around rinse bar 116 without blocking portions of rinse bar 116. These configurations may, however, be altered. For example, all of brackets 118 and 120 may be configured to wrap completely around rinse bar 116 to provide greater support to rinse bar 116, or one or more of any combination of brackets may be open at the bottom while one or more other brackets may wrap completely around rinse bar 116.

Figure 3:
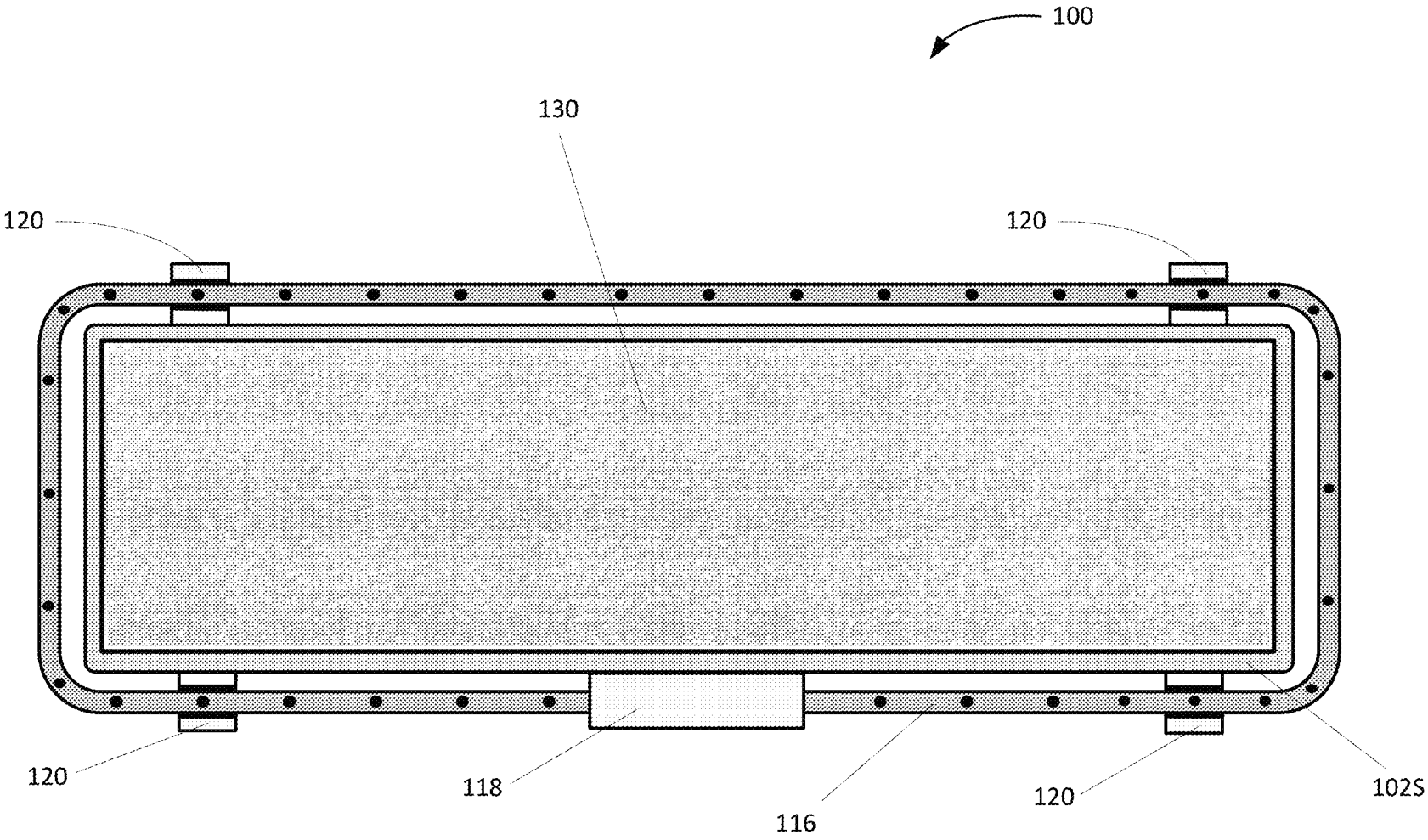
FIG. 3 illustrates an additional bottom view of the exemplary cleaning device according to at least one embodiment.

To further facilitate cleaning of a surface, a cleaning material (e.g., brush, bristles, scrub pad, abrasive pad, steel wool, sponge, or the like) may be attached to a lower surface 102S to scrub and clean a surface. Lower surface 102S of plate 102 may include features for removably attaching the cleaning material to plate 102. For example, fixing strips 128 may be attached to lower surface 102S in order to provide an attachment for the cleaning material. Fixing strips 128 may be any material (e.g., Velcro/hook and loop, adhesive, or other) for fixing a cleaning material to a surface. Additionally, a cleaning material may be fixed to surface 102S without using fixing strips 128. For example, a cleaning material may be fixed to surface 102S using screws, fasteners, snaps, liquid or spray adhesive, fittings, interference fitting, gripping teeth, or the like. FIG. 3 illustrates a scrub pad 130 fixed to lower surface 102S of plate 102 as the cleaning material. As described above, the cleaning material is not limited to a scrub pad but may include any material used for cleaning, abrading, or scrubbing a surface such as a brush, bristles, a scrub pad, an abrasive pad, steel wool, sponge, or the like.

Figure 4:
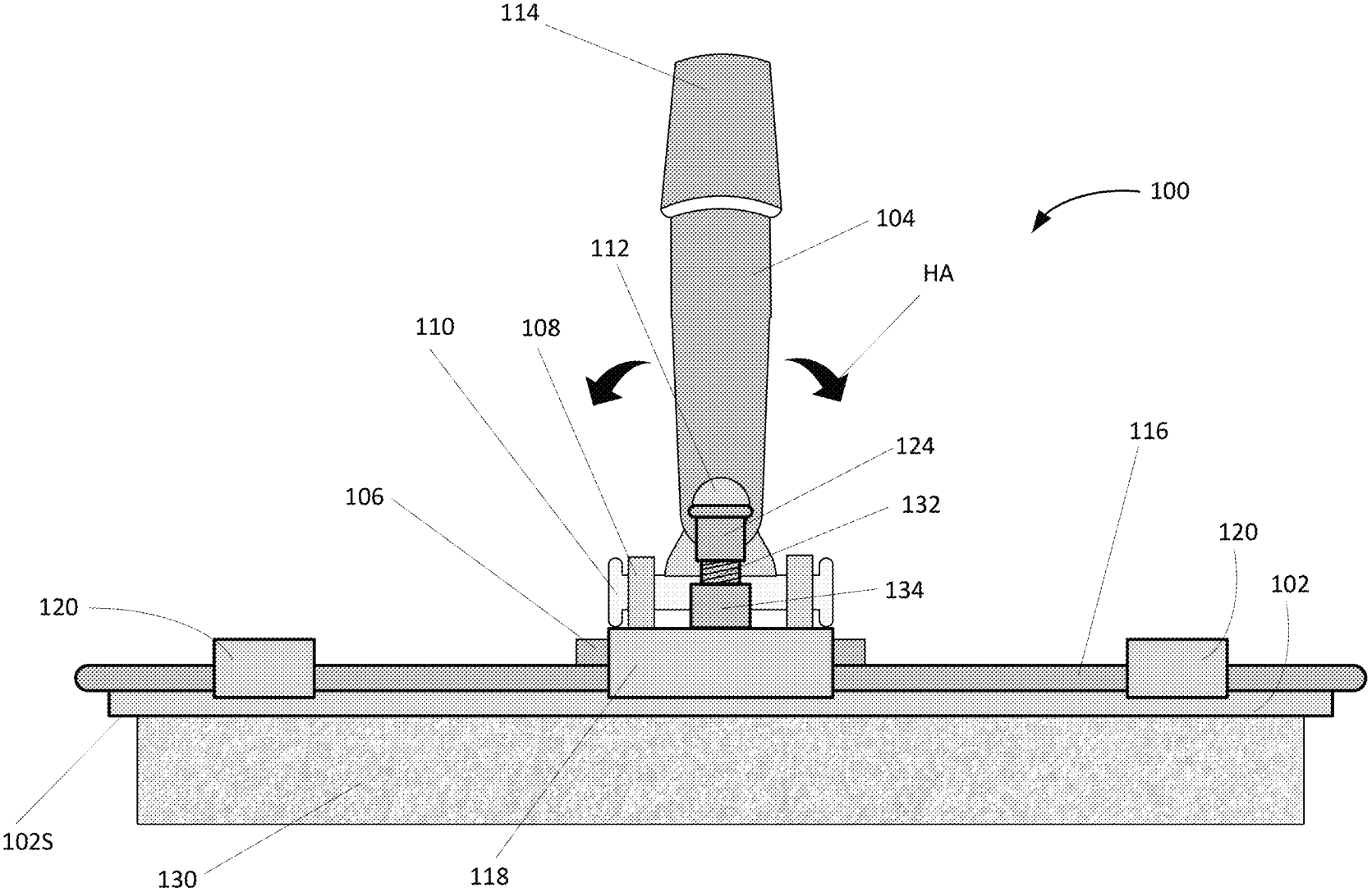
FIG. 4 illustrates a front view of the exemplary cleaning device according to at least one embodiment.

FIG. 4 illustrates a front view of cleaning device 100 and provides an alternate view of rinse inlet port 124. As shown, rinse inlet port 124 may include a threaded portion 132 that fits into a fluid opening port 134 of main bracket 118. Threaded portion 132 allows for easy removability and replacement of rinse inlet port 124. For example, should rinse inlet port 124 become broken or worn, it may be easily removed from the fluid opening port 134 of main bracket 118 and replaced with a new, fresh, or refurbished rinse inlet port 124. Threaded portion 132 may also have a different configuration and still be used in cleaning device 100. For example, fluid opening port 134 may be a push connector and threaded portion 132 may be a fitting that is inserted into a push connector. Additionally, any number (e.g., one or more) of rinse inlet ports may be attached to rinse bar 116. Other configurations may also be used (e.g., any fluid fittings, connectors, hoses, tubes using threaded connections, push connections, twist and lock connections, or any other configuration of attaching fluid fittings to an inlet) that allow connections and fluid communication between inlet ports and a rinse bar.

Figure 5:
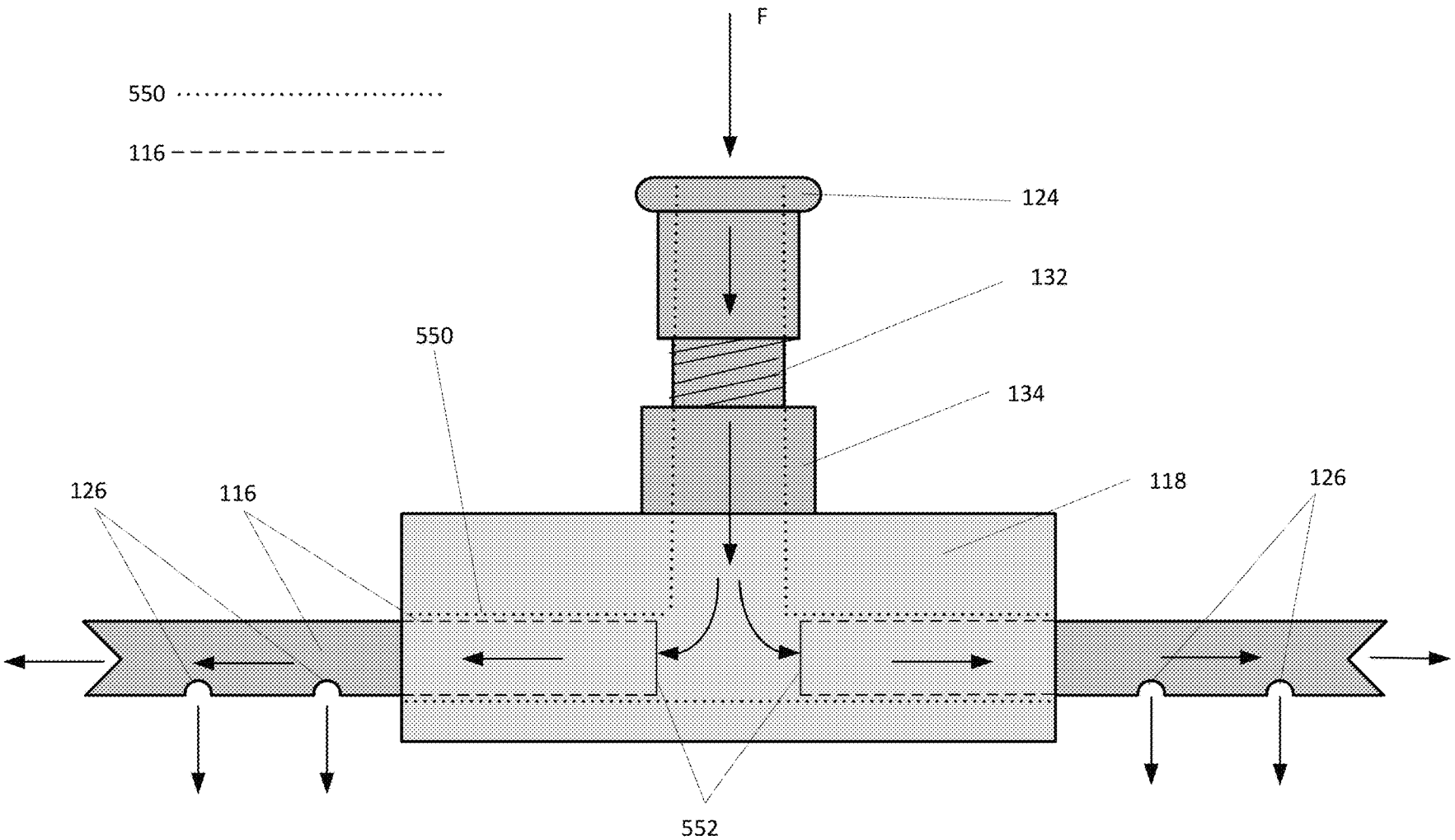
FIG. 5 illustrates a partial front view of the exemplary cleaning device according to at least one embodiment and shows internal configurations of parts of the exemplary cleaning device.

Fluid communication between, and internal channels of, rinse inlet port 124, threaded portion 132, fluid opening port 134, main bracket 118, and rinse bar 116 are illustrated in FIG. 5. FIG. 5 shows a zoomed in portion of cleaning device 100 that includes only a portion of rinse bar 116. As shown in the figure, rinse inlet port 124, threaded portion 132, fluid opening port 134, main bracket 118, and rinse bar 116. Each of these elements includes internal channels, indicated by dotted line 550. As illustrated Fluid flow F may be supplied to an opening of rinse inlet port 124. The fluid flow F may flow through rinse inlet port 124, through threaded portion 132, and into main bracket 134 through fluid opening port 134. Once inside main bracket 118, fluid flow F flows through internal channels 550 toward openings 552 of rinse bar 116 connected to main bracket 118. The fluid flow F then enters rinse bar 116, flows throughout rinse bar 116 and exits through holes 126 formed in rinse bar 116 toward a surface being cleaned.

The cleaning device is not limited to the configuration shown in FIG. 5. For example, although FIG. 5 shows that ends/openings 552 of rinse bar 116 are separate from each other, the rinse bar may be continuous and include an inlet hole formed in the portion of rinse bar 116 within main bracket 118 to allow fluid flow F to enter rinse bar 116.

Maneuverability of cleaning device 100 with respect to handle 104 will be described with reference to FIGS. 4, 6, 7A, and 7B. As described above, handle 104 may be configured to allow plate 102 to be maneuvered in multiple directions. First supports 108 and pin 110 inserted through holes formed in first supports 108 allow plate 102 to pivot in a first direction (e.g., vertical direction) relative to handle 104. Second support 111 and pin 112 inserted through handle 104 and a hole in second support 111 allow plate 102 to pivot in a second direction (e.g., horizontal direction) relative to handle 104. First supports 108 combined with pin 110 may be described as a "first pivot" and second support 111 combined with pin 112 may be described as a "second pivot."

Figure 6:
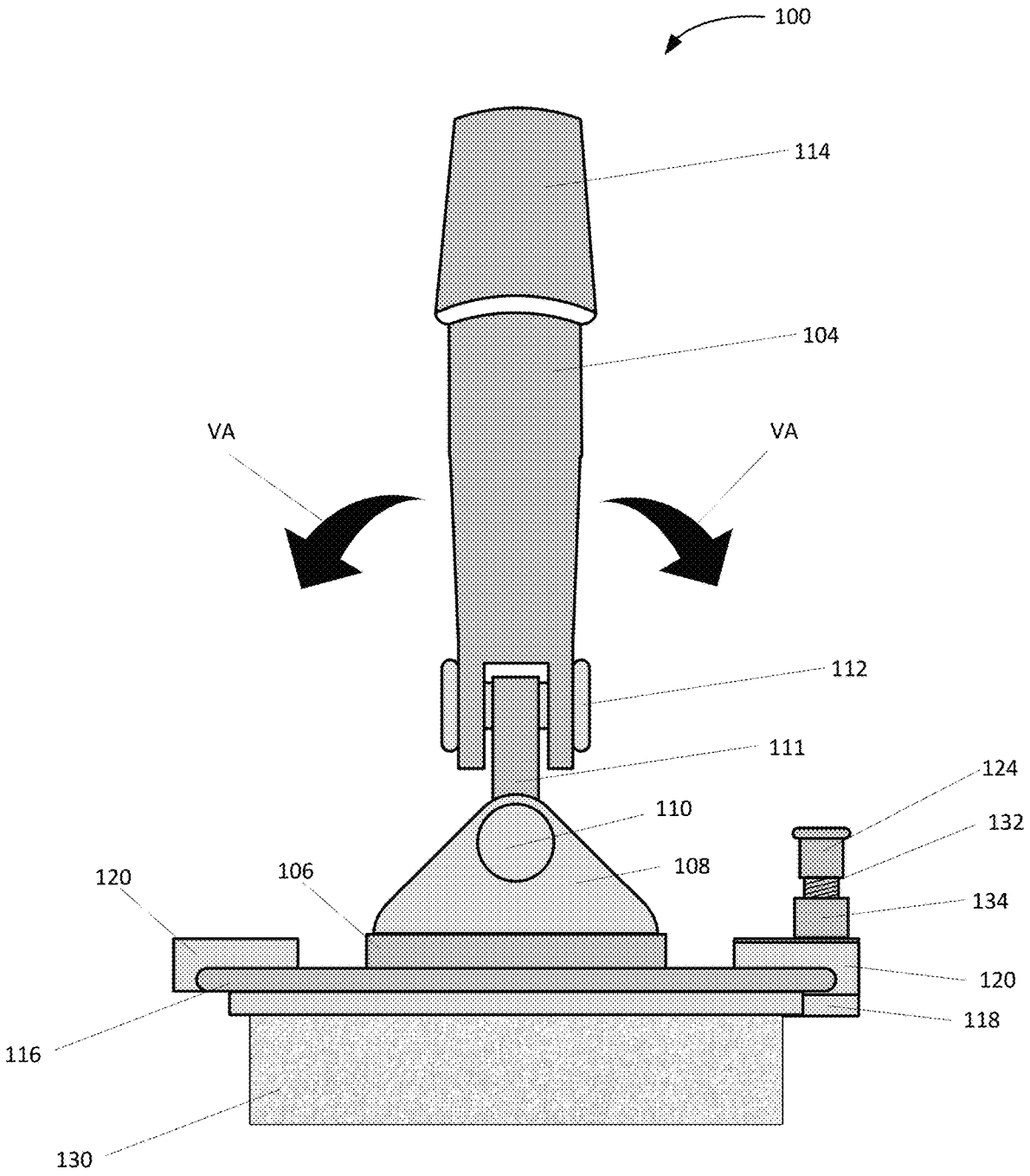
FIG. 6 illustrates a side view of the exemplary cleaning device according to at least one embodiment.
Figures 7A, 7B:
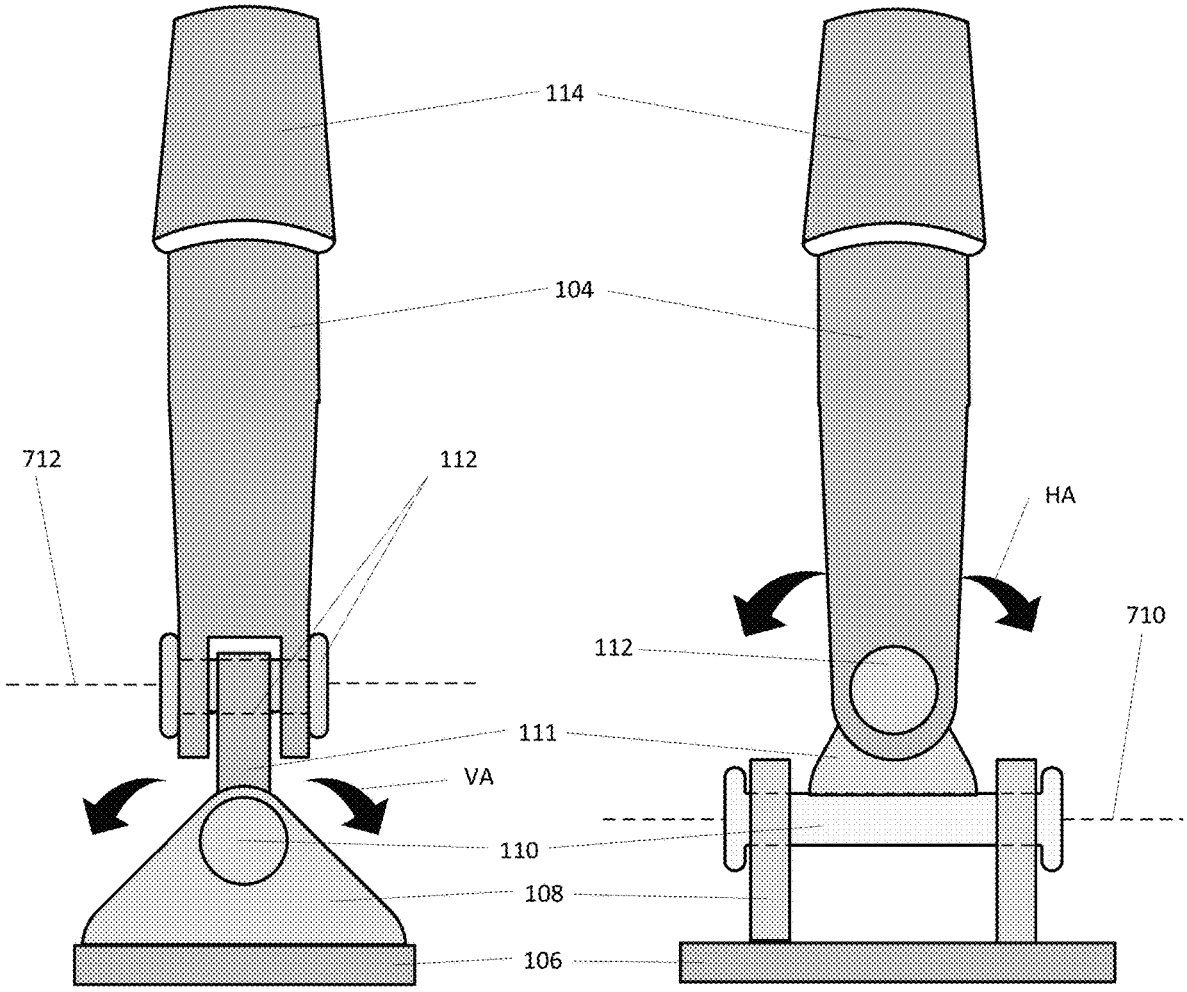
FIG. 7A illustrates a side view of an exemplary handle of the exemplary cleaning device according to at least one embodiment.
FIG. 7B illustrates a front view of an exemplary handle of the exemplary cleaning device according to at least one embodiment.

As illustrated in FIG. 6, first pivot (e.g., first supports 108 and pin 110) allows handle 104 to pivot/rotate with respect to plate 102 in a first direction (vertical direction with respect to plate 102) represented by arrows VA. As illustrated in FIG. 4, second pivot (e.g., second support 111 and pin 112) allows handle 104 to pivot/rotate with respect to plate 102 in a second direction (horizontal direction with respect to plate 102) represented by arrows HA. The vertical direction and horizontal direction are perpendicular to each other. It is to be appreciated that, depending on which element is considered as stationary (e.g., handle 104 or plate 102) the first pivot may also be considered to allow plate 102 to pivot/rotate with respect to handle 104 in the first direction and the second pivot may also be considered to allow plate 102 to pivot/rotate with respect to handle 104 in the second direction. FIGS. 7A and 7B illustrate side and front views of handle 104. As shown in FIGS. 7A and 7B, handle 104/plate 102 rotates in direction VA about an axis 710 of pin 110. As shown in FIGS. 7A and 7B, handle 104/plate 102 rotates in direction HA about an axis 712 of pin 112.

The multiple combined directions of rotation for plate 102 relative to the handle 104 allows plate 102 to be maneuvered omni-directionally and provides an advantage of allowing users of cleaning device 100 to maneuver the device in a variety of different situations for cleaning a variety of different surfaces, including situations and surfaces that are difficult or impossible to clean without an omni-directional cleaning device.

One or more of the pivots or movement directions may be omitted while still allowing cleaning device 100 to be usable for cleaning surfaces. Additionally, it may be desirable, depending on situations or surfaces, for a user to temporary limit movement of plate 102 relative to handle 104. Accordingly, one or more of the pivots may include locking pins or other locking devices to allow a user to selectively lock one or more pivots and restrain plate 102 in one or more of the movement directions. This gives users of the device more options and variety to accomplish a variety of different tasks, including cleaning different surfaces in different situations, with a cleaning device.

Figure 8:
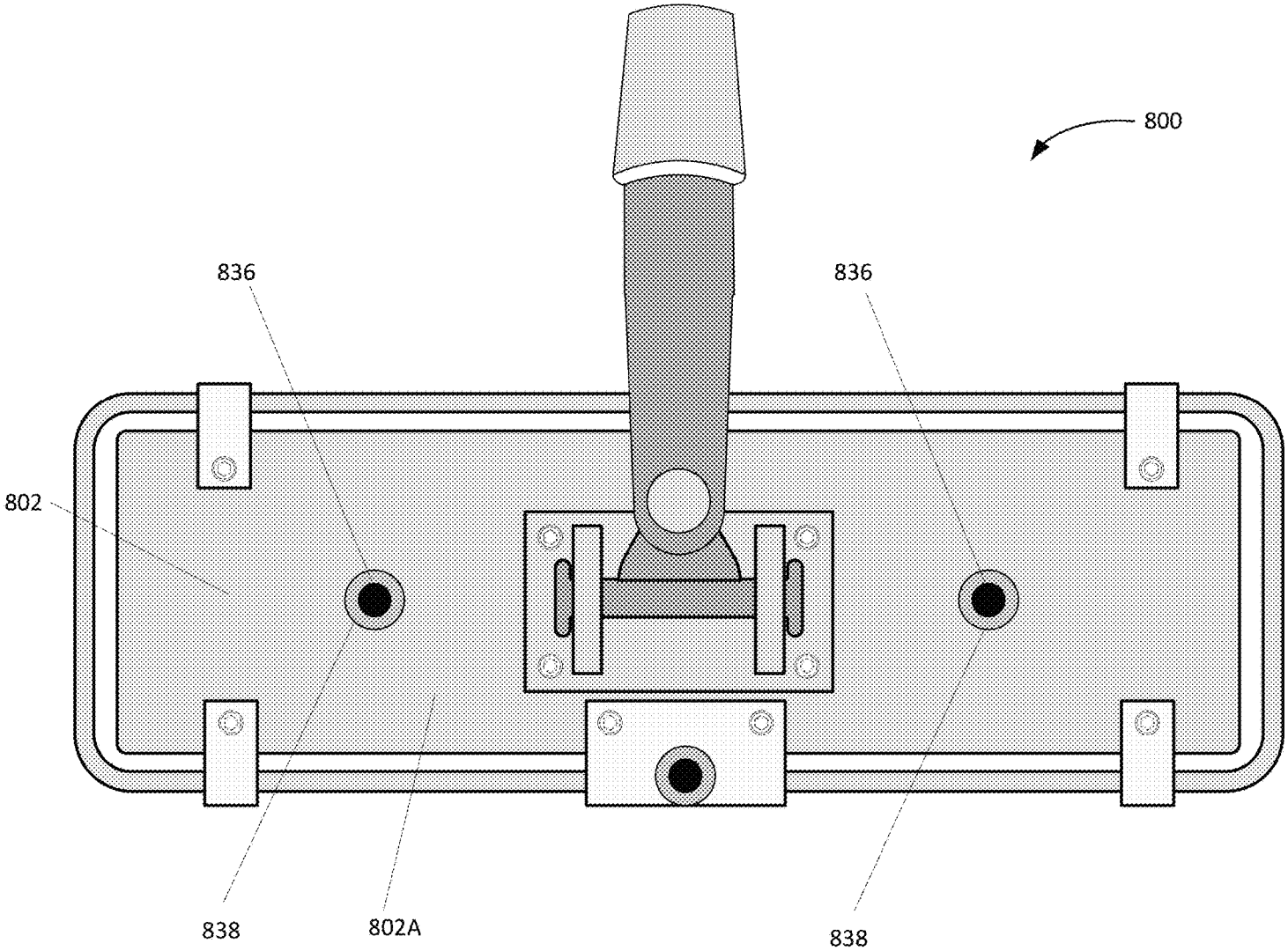
FIG. 8 illustrates a top view of an alternative embodiment of an exemplary cleaning device according to at least one embodiment.

An alternative embodiment will now be described with respect to FIGS. 8-11. A top view of cleaning device 800 according to the alternative embodiment is illustrated in FIG. 8. As shown, many of the elements in cleaning device 800 are similar to those in cleaning device 100 and, therefore, there description will not be repeated here. In addition to the elements of cleaning device 100, cleaning device 800 further includes a pair of fluid inlet ports 838 attached adjacent to a pair of fluid openings 836.

Figure 9:
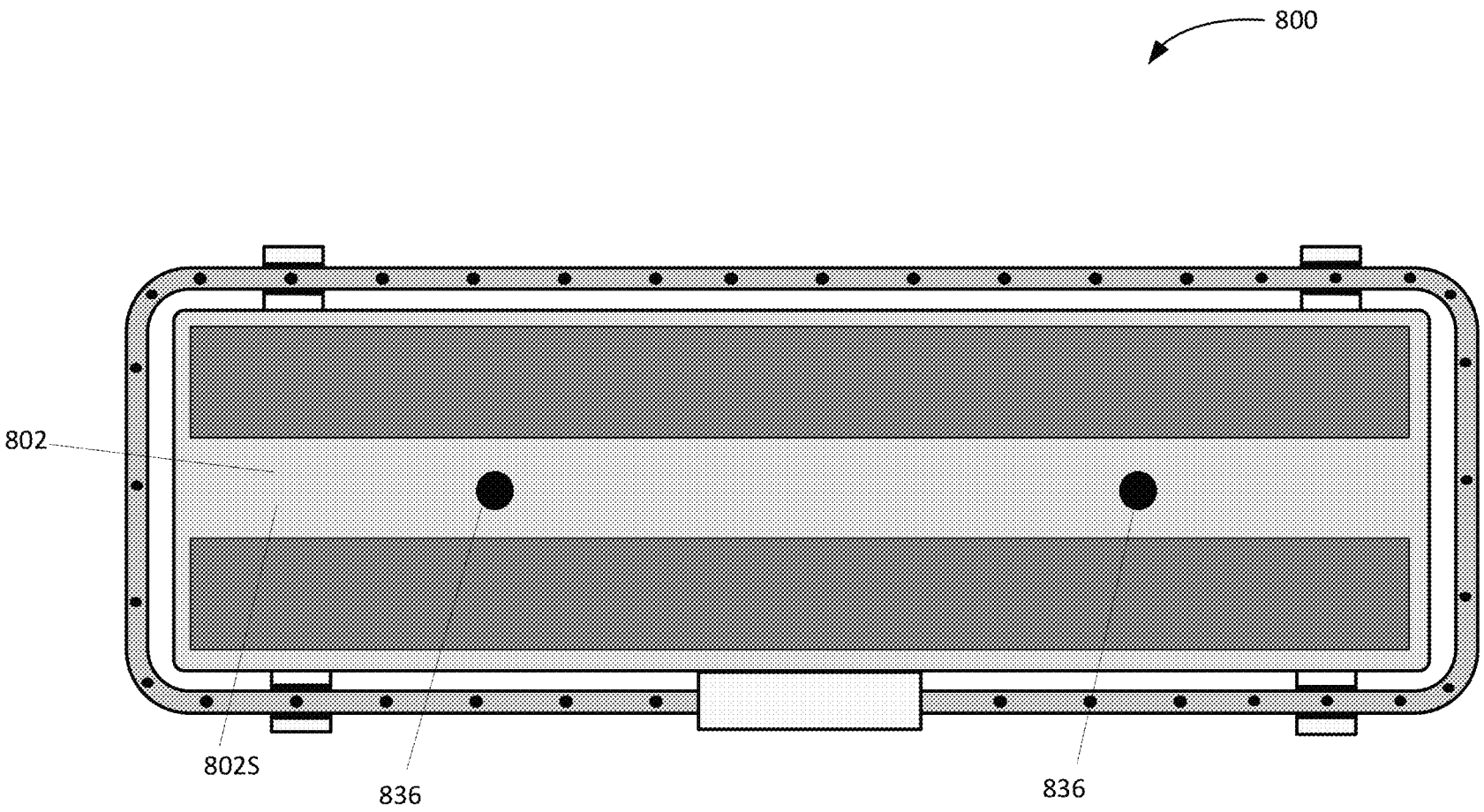
FIG. 9 illustrates a bottom view of an alternative embodiment of the exemplary cleaning device according to at least one embodiment.

The fluid openings 836 are formed in plate 802. As shown in FIGS. 8 and 9, fluid openings formed through the entire plate 802 and extend from an upper surface 802A of plate 802 through to a lower surface 802S of plate 802. Accordingly, fluid supplied to fluid inlet ports 838 flows through plate 802 and is deposited on cleaning material (e.g., brush, bristles, scrub pad, abrasive pad, steel wool, sponge, or the like) disposed on lower surface 802S of plate 802. The fluid supplied to fluid inlet ports 838 may pass through the cleaning material and be used to clean a surface.

Although FIGS. 8-11 show a pair of fluid inlet ports 838 and fluid openings 836, it is to be appreciated that the disclosure is not limited to this configuration. Cleaning device 800 may include one or more fluid inlet ports 838. Furthermore, additional fluid inlet ports 838 may be disposed anywhere on plate 102, or may feed fluid directly to the rinse bar to mix with fluid fed to the rinse bar through the rinse inlet port.

Figure 10:
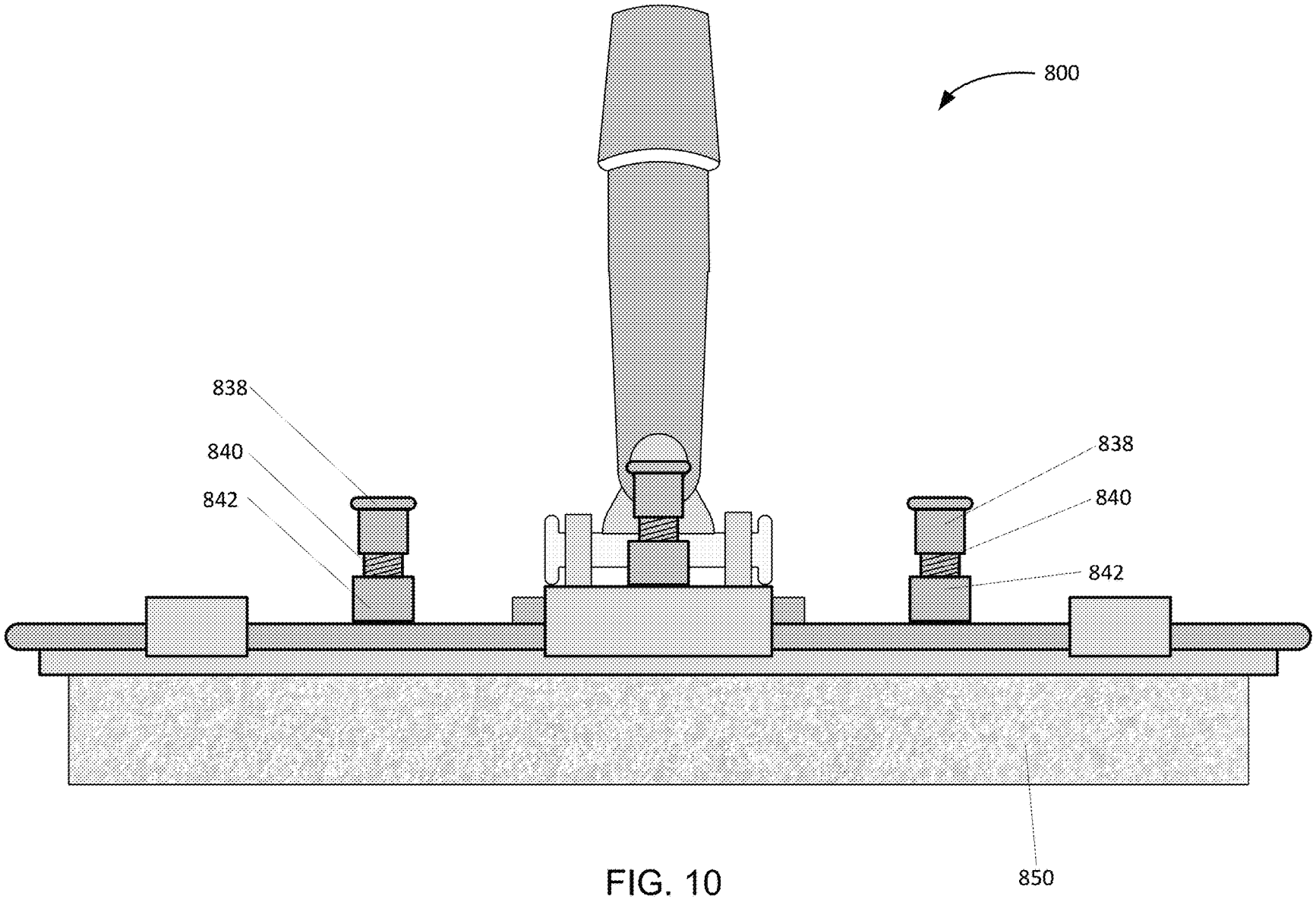
FIG. 10 illustrates a front view of an alternative embodiment of the exemplary cleaning device according to at least one embodiment.
Figure 11:
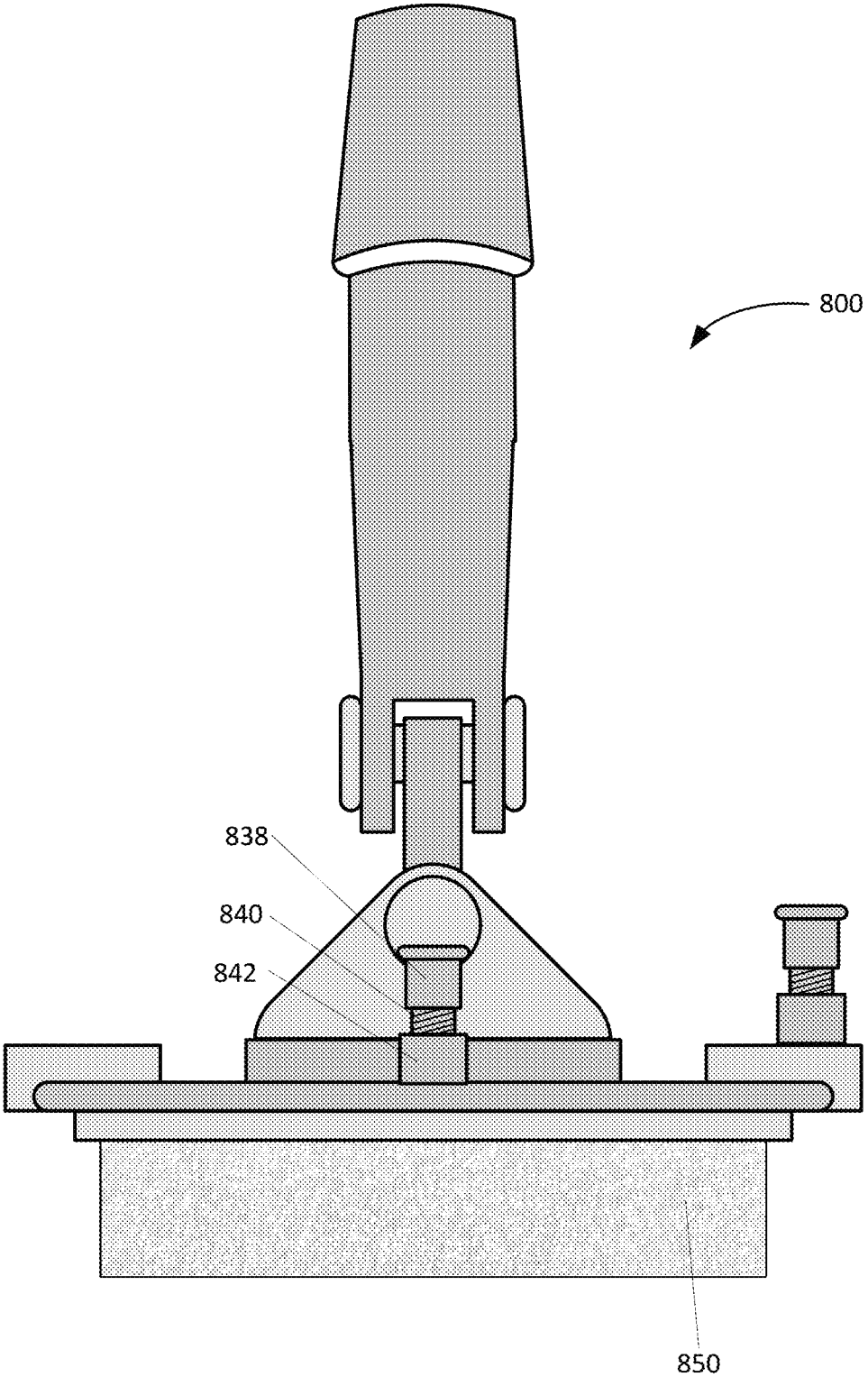
FIG. 11 illustrates a side view of an alternative embodiment of the exemplary cleaning device according to at least one embodiment.

As shown in FIGS. 10 and 11, fluid inlet ports 838 may have a similar configuration to rinse inlet port 134. As shown in FIG. 10, fluid inlet ports 838 may include a threaded portion 840 that fits into a fluid opening port 842 on plate 802. Threaded portion 840 allows for easy removability and replacement of fluid inlet ports 838. For example, should fluid inlet port 838 become broken or worn, it may be easily removed from the fluid opening port 842 and replaced with a new, fresh, or refurbished rinse inlet port 838. Threaded portion 840 may also have a different configuration and still be used in cleaning device 800. For example, fluid opening port 842 may be a push connector and threaded portion 840 may be a fitting that is inserted into a push connector. Other configurations may also be used (e.g., any fluid fittings, connectors, hoses, tubes using threaded connections, push connections, twist and lock connections, or any other configuration of attaching fluid fittings to an inlet) that allow connections and fluid communication between inlet ports, plate 802, and the cleaning material (e.g., pad 850).

Figure 12B:
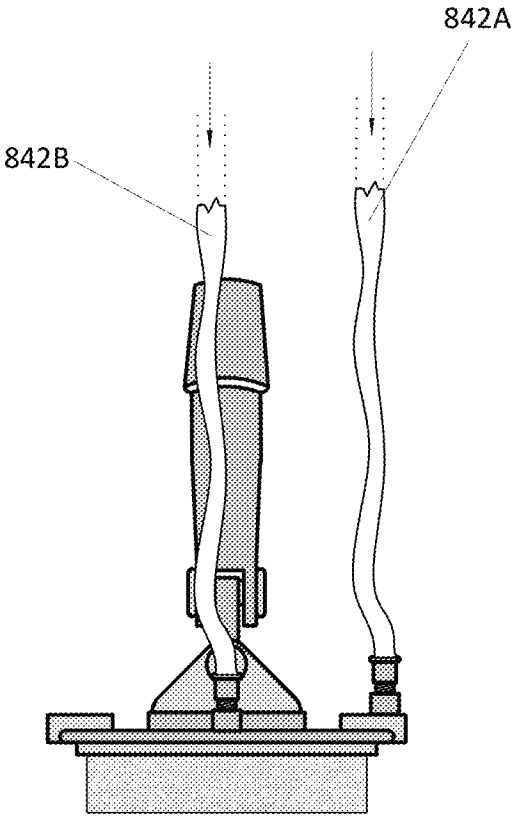
FIG. 12B illustrates a side view of an alternative embodiment of the exemplary cleaning device with fluid-supply tubing attached according to at least one embodiment.
Figure 12A:
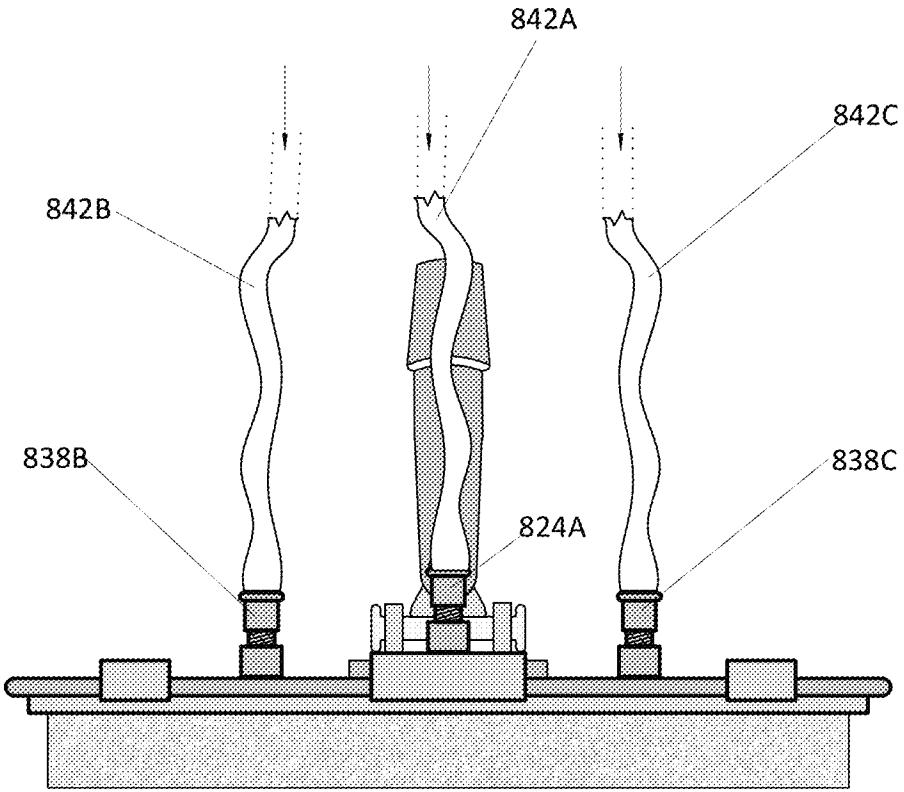
FIG. 12A illustrates a front view of an alternative embodiment of the exemplary cleaning device with fluid-supply tubing attached according to at least one embodiment.

Illustrations of cleaning device 800 connected to fluid supply tubing 842A-842C are shown in FIGS. 12A and 12B. As shown, fluid supply tubings 842A, 842B, and 842C may be connected respectively to rinse inlet port 824A, fluid inlet port 838B, and fluid inlet port 838C such that the fluid supply tubings 842A, 842B, and 842C and inlet ports 824A, 838B, and 838C are respectively in fluid communication with each other. Each of fluid supply tubings 842A, 842B, and 842C may supply each of inlet ports 824A, 838B, and 838C with the same type of cleaning fluid (e.g., water, purified water, soap, solvent, detergent, cleanser, or any other suitable fluid for cleaning surfaces). Alternatively, different fluids may be supplied to each of the inlet ports 824A, 838B, and 838C. In an alternative configuration, the fluid inlet ports 838B and 838C may be supplied with different cleaning fluid then the rinse inlet port, or one of the fluid inlet ports may be supplied with the same fluid as rinse inlet port while the other fluid inlet port is supplied with a different fluid. The combinations of which fluids are supplied to which ports are not particularly limited.

Although FIGS. 12A and 12B illustrate cleaning device 800, it is to be understood that connecting tubing to rinse inlet port 124 of cleaning device 100 may be carried out in the same or similar way as for cleaning device 800. The connectors used for connecting fluid supply tubing to inlet ports 124, 824A, 838B, and 838C are not particularly limited. Any connection (e.g., press-fit connectors, push connectors, threaded connectors, twist-and-lock connectors, or other fluid connectors) may be used to connect tubing to inlet ports.

Figure 13:
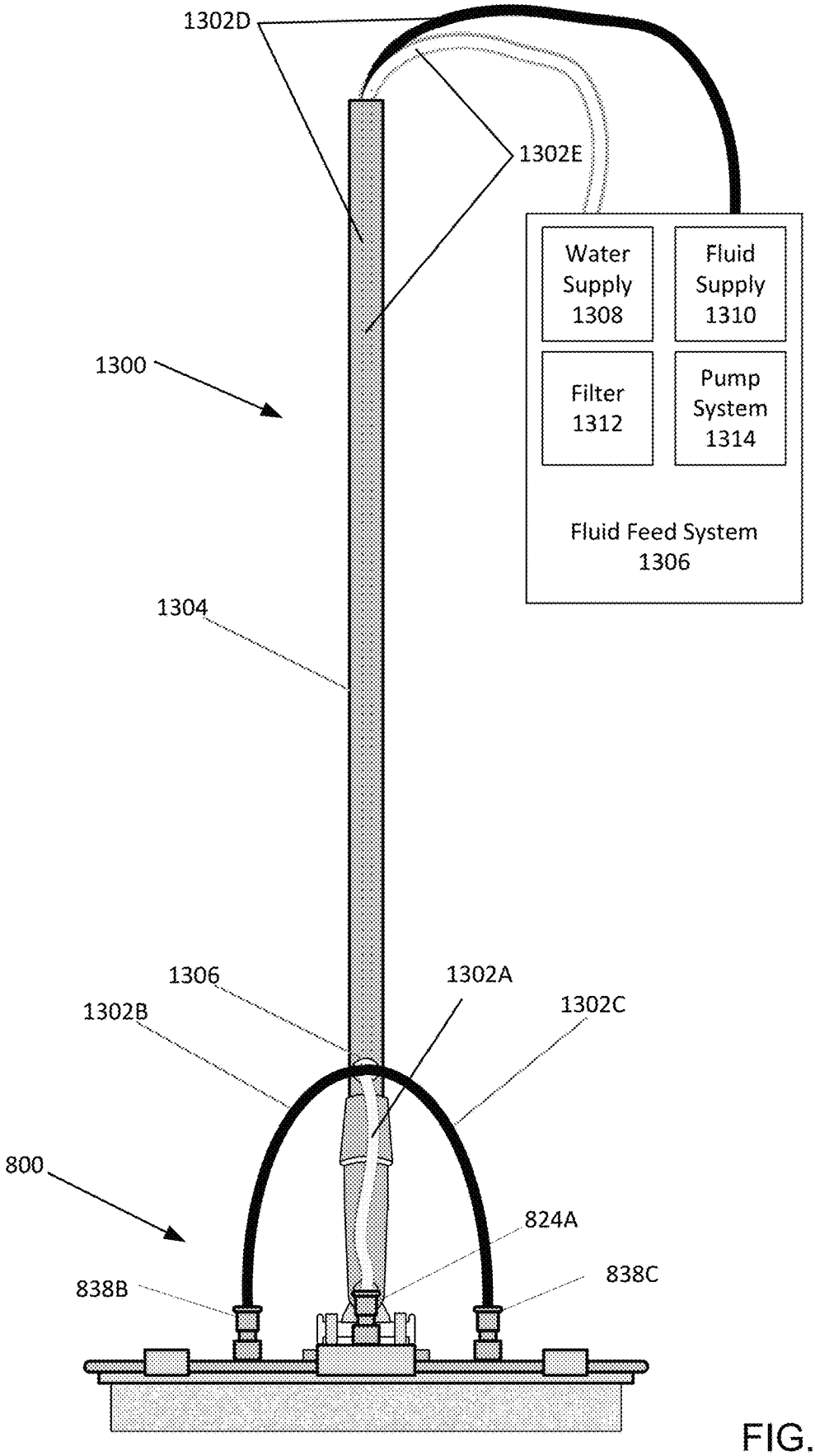
FIG. 13 illustrates an exemplary cleaning system according to at least one embodiment.

An exemplary cleaning system 1300 is illustrated in FIG. 13. As shown cleaning system 1300 may include cleaning device 800. Alternatively, cleaning system may include cleaning device 100 or any other cleaning device according to the examples and embodiments described herein. Cleaning device 800 of cleaning system 1300 may be attached to a fluid-fed pole 1304 via a connector such as, for example, connector 114 described herein. Rinse inlet port 824A and fluid inlet ports 838B and 838C are respectively connected to fluid supply tubing 1302A-1302C. As shown in FIG. 13, fluid supply tubing 1302A-1302C may enter fluid-fed pole 1304 through opening 1306 and continue through the pole 1304. Fluid supply tubing 1302B-1302C may both be connected to fluid supply tubing 1302D inside pole 1304 and fluid supply tubing 1302D may in turn be connected to fluid feed system 1306. Fluid supply tubing 1302A may be connected to fluid supply tubing 1302E inside pole 1304 and fluid supply tubing 1302E may in turn be connected to fluid feed system 1306. The separate nature of fluid supply tubing 1302A from 1302B/1302C prevents cross contamination between the tubes.

For example in an embodiment, in order to avoid cross-contamination between separate tubing supplying separate fluid, fluid supply tubing 1302B, 1302C, and 1302D may be only in fluid communication with fluid supply 1310 of fluid feed system 1306 in order to ensure that fluid supply tubing 1302B, 1302C, and 1302D only receive the type of fluid supplied from fluid supply 1310. Similarly, fluid supply tubing 1302A and 1302E may only be in fluid communication with water supply 1308 of fluid feed system 1306 in order to ensure that fluid supply tubing 1302A and 1302E only receive the type of fluid supplied from water supply 1308. Alternative configurations may include extra tubing in order to have any number of tubings each being supplied with their own type of fluid. Additionally, two or more tubings may be configured to receive the same type of fluid.

Fluid supply tubing 1302A-1302C may be connected to fluid supply tubing 1302D inside pole 1304 and fluid supply tubing 1302D may in turn be connected to fluid feed system 1306.

It is to be appreciated that fluid supply tubing 1302A-1302C may be connected to the same fluid supply tubing 1302D, in which case, each of fluid supply tubing 1302A-1302C are supplied with the same water or cleaning fluid. It is further to be appreciated that fluid supply tubing 1302A-1302C may each be connected to the different fluid supply tubing, in the case in which each of fluid supply tubing 1302A-1302C are supplied with the different fluids. Furthermore, any combination of two of fluid supply tubing 1302A-1302C may be connected to the same fluid supply tubing such that only one of the fluid supply tubing 1302A-1302C is supplied with different fluid then the other two of fluid supply tubing 1302A-1302C (e.g., fluid inlet ports 838B and 838C are supplied with a different fluid than rinse inlet port 824A). Any combination of fluid supplied to the tubing is to be understood to be within this disclosure.

As further illustrated in FIG. 13, cleaning system 1300 may include a fluid feed system 1306. Fluid feed system 1306 may include one or more of the following components: a water supply 1308 containing water, either pressurized or unpressurized, that is fed through fluid supply tubing 1302D; a fluid supply 1310 for providing a cleaning fluid other than water through the fluid supply tubing; a filter 1312 for filtering water or other fluid supplied to cleaning device 800 through the fluid feed tubing; and a pump system 1314 for pumping fluid/water through cleaning system 1300. The cleaning fluid supplied by fluid supply 1310 may include any fluid for aiding in cleaning a surface (e.g., window cleaners, abrasive cleaners, solvents, detergents, soaps, or other cleansing fluids).

Several alternative configurations and embodiments of cleaning devices described herein are within the scope of this disclosure. For example, the rinse bar may be fixed directly to the plate of the cleaning device instead of being held by brackets. The rinse bar may also be integrated with the plate, such that the plate and rinse bar are one piece instead of separate pieces. The rinse bar may extend only around one, two, or three edges of the plate. The handle may be any handle that allows an omnidirectional maneuverability of the plate. Additionally, the plate may be any shape (e.g., circular, oval, triangular, square, or any other shape) not just rectangular, and the rinse bar may be configured to match any shape of the plate. The cleaning device may include more or less fluid inlets than are pictured or described in any of the embodiments herein.

Figure 14A:
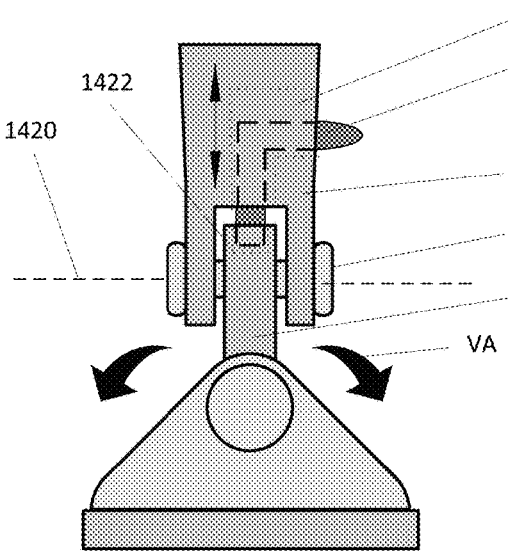
FIGS. 14A-14D illustrate exemplary views of an exemplary handle of the exemplary cleaning device including a locking device according to at least one embodiment.
Figure 14B:
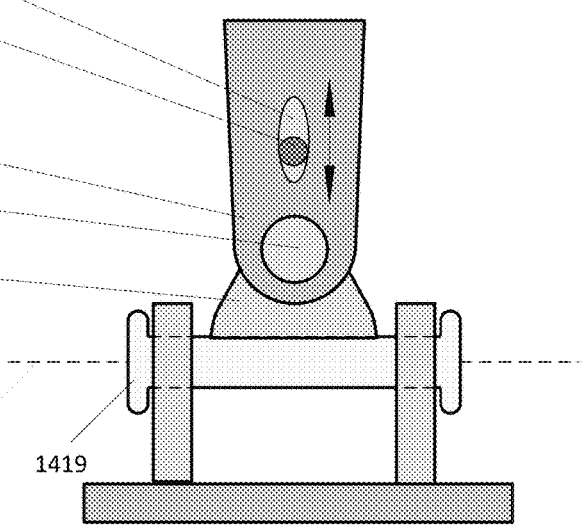
Figure 14C:
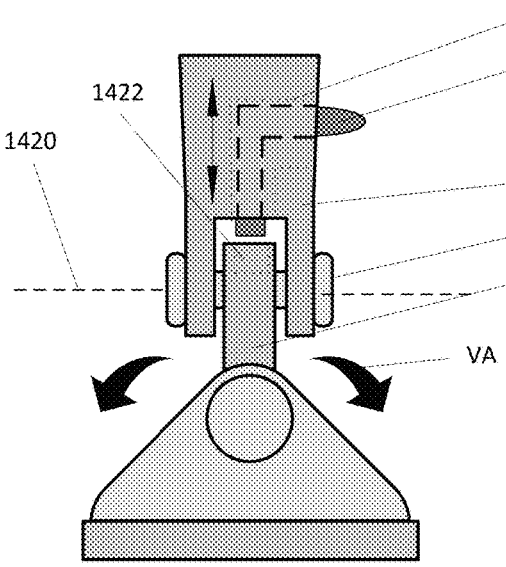
Figure 14D:
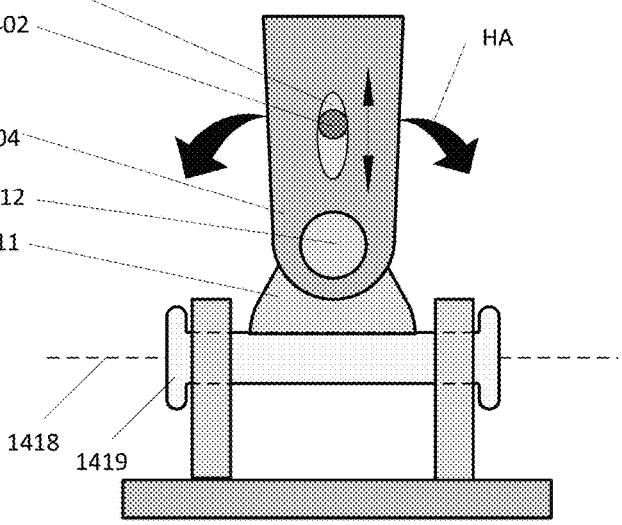

An alternative exemplary configuration of the handle of the device will be described with reference to FIGS. 14A-14D. An exemplary handle 1404 including a locking mechanism 1402. A front view and a side view of handle 1404 where locking mechanism 1402 is in a locked position are shown in FIGS. 14A and 14B respectively. As shown in FIGS. 14A and 14B, handle 1404 rotates in direction VA about an axis 1418 of pin 1419. As shown in FIG. 14D, handle 1504 rotates in direction HA about an axis 1420 of pin 1412.

The locking mechanism 1402 may be included in handle 1404 in order to constrain handle 1404 from rotating about one or more pins 1412 and 1419. For example, as shown FIGS. 14A and 14B, locking mechanism 1402 (shown by dashed lines inside of handle 1404 and support 1411) may move between an up position (unlocked position) and a down position (locked position) as toggled by a user in the directions shown by arrows in the FIGS. 14A and 14B. When locking mechanism 1402 is moved by a user, it slides up and down in a cavity 1401 (shown by dotted lines inside of handle 1404) formed in handle 1404. FIGS. 14A and 14B show side and front views of handle 1404 respectively. In FIGS. 14A and 14B, locking mechanism 1402 is in a locked position. As shown in FIG. 14A, in the locked position, locking mechanism 1402 engages with support 1411. Locking mechanism 1402 may engage with a flat surface of support 1411, or may engage with a notch 1422 formed in support 1411. In the locked position, locking mechanism locks handle 1404 in position relative to support 1411 and thereby prevents rotation of handle 1404 about axis 1420 and pin 1412.

For various situations (e.g., cleaning windows on very tall buildings or cleaning windows several stories above the user of the device), it may provide more stability and greater control to the user to have one or more of the rotation axes of the device constrained. This allows for more stability and more comfort in cleaning windows/surfaces at large distances.

For situations where a user desires the extra rotation axis 1420, a user may slide locking mechanism 1402 to an unlocked position which disengages locking mechanism 1402 from notch 1422 in support 1411. Thus handle 1404 is again allowed to rotate in direction HA about axis 1420 and pin 1422. This unlocked position and configuration is shown in FIGS. 14C and 14D. A locking mechanism may further be included to lock rotation about axis 1418 and pin 1419. Additionally, locking mechanism 1402 may be spring-loaded to either extend into the locked position or to retract to an unlocked position. The spring-loaded locking mechanism 1402 may lock in the locked position when it is spring-loaded to retract away from the locked position. In such a configuration, releasing the locking mechanism 1402 from the lock in the locked position will cause the locking mechanism to spring back to the unlocked position.

In another configuration, the spring-loaded locking mechanism 1402 may lock in the unlocked position when it is spring-loaded to extend to the locked position. In such a configuration, releasing the locking mechanism 1402 from the lock in the unlocked position will cause the locking mechanism to spring back to the locked position.

Figure 15A:
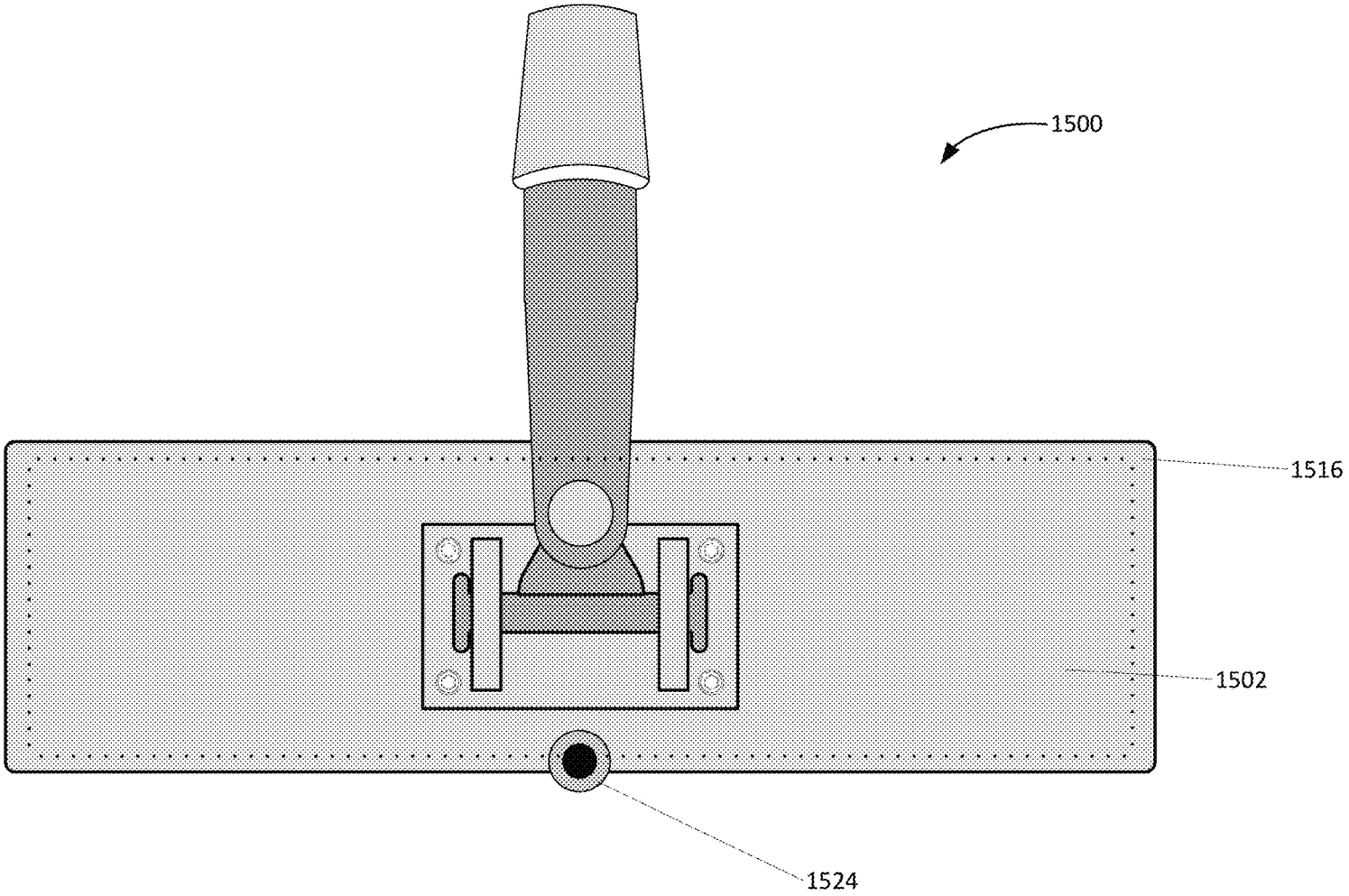
FIGS. 15A and 15B illustrate exemplary views of and exemplary cleaning device according to at least one embodiment.

An alternative exemplary configuration of the handle of the device will be described with reference to FIGS. 15A and 15B. In FIG. 15A a top view of an exemplary cleaning device 1500 is shown. According to this example, the rinse bar 1516 may be integrated with plate 1502 of cleaning device 1500. A hollow passage formed in plate 1502 is outlined using a dotted line in FIG. 15A. This hollow passage of plate 1502 may be integrated rinse bar 1516 which is integrated with plate 1502 so that no outside rinse bar needs to be attached to plate 1502. Instead, fluid may enter rinse inlet port 1524 and flow through integrated rinse bar 1516.

Figure 15B:
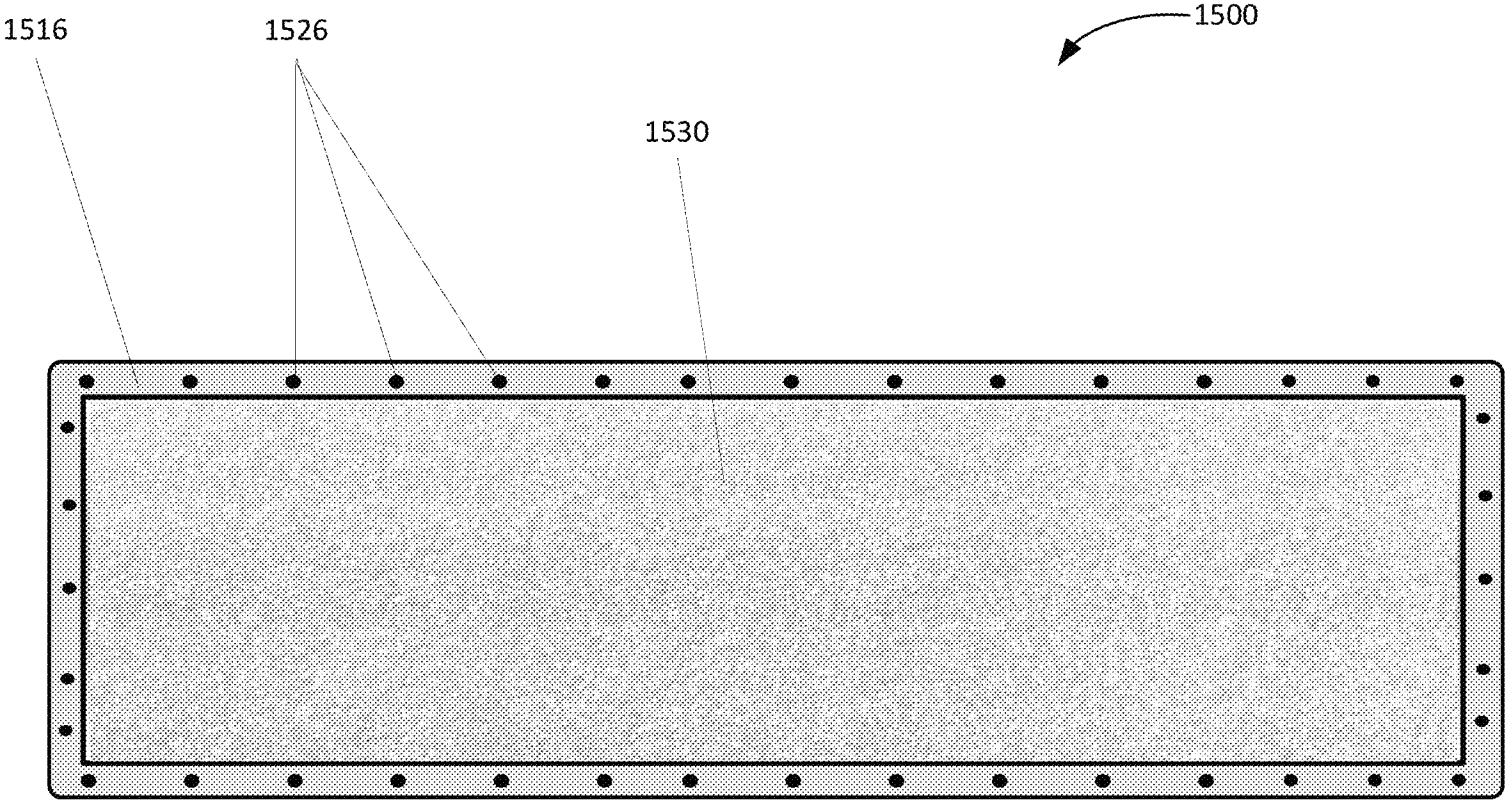

As shown in FIG. 15B, which is a bottom view of cleaning device 1500, a plurality of holes 1526 may be formed in integrated rinse bar 1516. The plurality of holes 1526 may be disposed to surround pad 1530 to dispense fluid around pad 1530. Thereby, fluid entering integrated rinse bar 1516 may be exit through holes 1526 and be incident on a cleaning surface being cleaned by cleaning device 1500.

Figure 16:
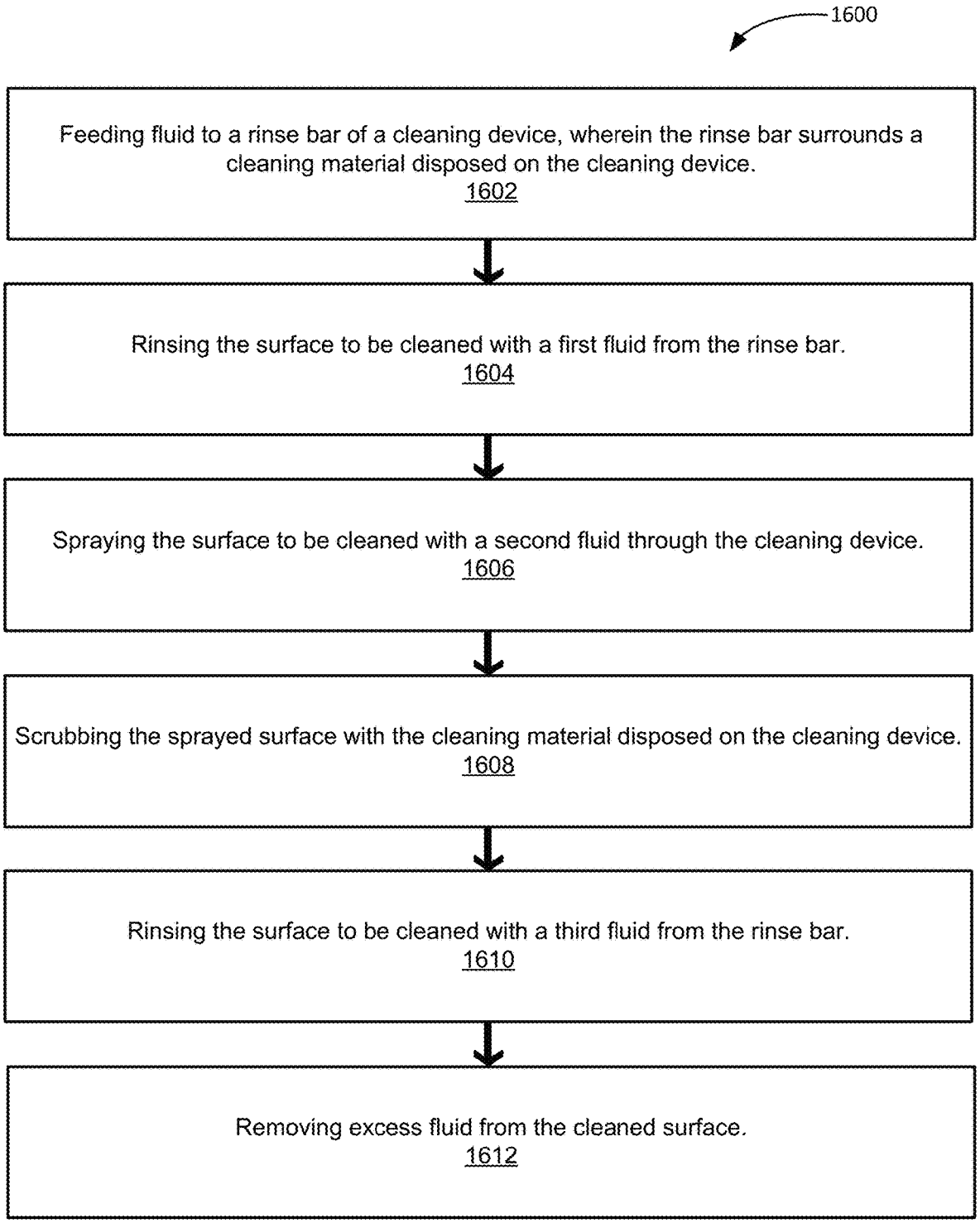
FIG. 16 illustrates steps of an exemplary method of cleaning a surface using the cleaning device described herein according to at least one embodiment.

Illustrated in FIG. 16 are steps for an exemplary method 1600 of cleaning a surface using a cleaning device according to any of the embodiments described herein. The method may include a step of feeding fluid to a rinse bar of the cleaning device, wherein the rinse bar surrounds a cleaning material disposed on the cleaning device as step 1602. The method may further include a step of rinsing the surface to be cleaned with a first fluid (e.g., water or other cleaning fluid) from the rinse bar as step 1604. The method may further include a step of spraying the surface to be cleaned with a second fluid (e.g., soap, cleanser, detergent, or cleaning fluid) through the cleaning device as step 1606. The method may further include a step of scrubbing the sprayed surface with cleaning material disposed on the cleaning device as step 1608. The method may further include a step of rinsing the surface to be cleaned with a third fluid (e.g., purified water or other cleaning fluid) from the rinse bar as step 1610. The method may further include a step of removing excess fluid from the cleaned surface as step 1612.

One or more steps described in the method may be omitted, (e.g., steps 1606, 1608, 1610, and/or 1612). The first fluid of step 1604 may be the same as the third fluid of step 1610. Step 1612 may be accomplished using any form of removing excess fluid (e.g., drying with an absorbent material/implement, drying with forced air, using a squeegee, or any other method for removing excess fluid). Alternatively to step 1612, the surface may be allowed to air dry with ambient air.

Figure 17:
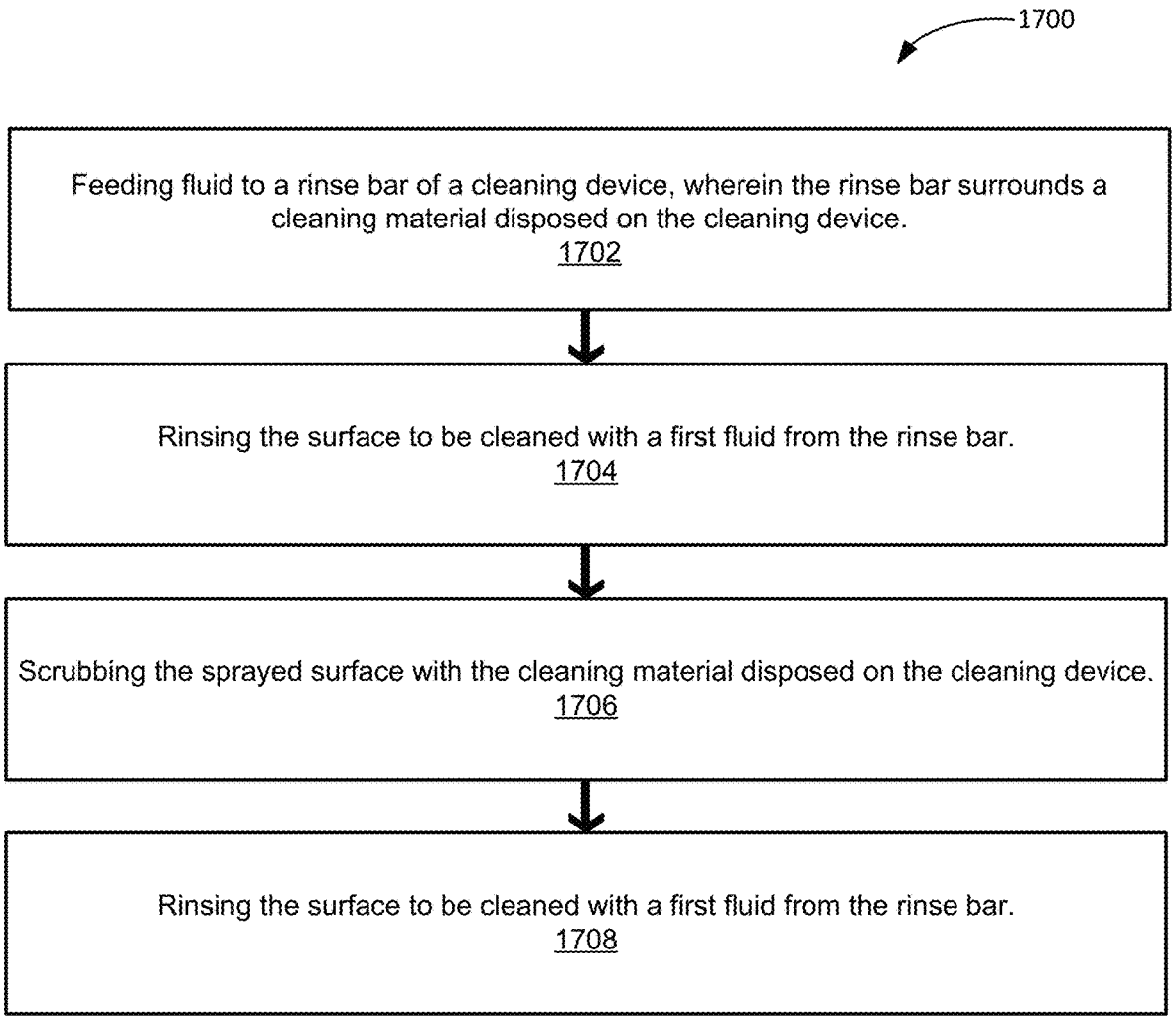
FIG. 17 illustrates steps of an exemplary method of cleaning a surface using the cleaning device described herein according to at least one embodiment.

A simplified method 1800 is described with reference to FIG. 17. As shown in FIG. 17, the method may include a step of feeding fluid to a rinse bar of the cleaning device, wherein the rinse bar surrounds a cleaning material disposed on the cleaning device as step 1702. The method may further include a step of rinsing the surface to be cleaned with a first fluid (e.g., water or other cleaning fluid) from the rinse bar as step 1704. The method may further include a step of scrubbing the sprayed surface with cleaning material disposed on the cleaning device as step 1706. The method may further include a step of rinsing the surface to be cleaned with a third fluid (e.g., purified water or other cleaning fluid) from the rinse bar as step 1708.

It is to be appreciated that one or more steps in methods 1600 and 1700 described above may be performed simultaneously with each other. For example, in method 1700 the water feeding and rinsing may be performed continuously where water is fed through the device to the rinse bar throughout the entire process. Accordingly, the water feeding of step 1702, the rinsing of step 1704, the scrubbing of step 1706, and the rinsing in step 1708 may all be performed simultaneously. This is also true for the steps of method 1600 in FIG. 16.

For cleaning a surface with methods 1600 and 1700, the rinse bar may be supplied with water that has been purified, processed, and/or filtered in such a way that the total dissolved solids ("TDS") in the water is very low parts per million ("ppm") or at zero. Water having zero ppm TDS will dry with minimal-to-no streaking and residue left behind, leaving clean surfaces and windows without excessive or undesirable spotting or residue left after cleaning. Use of very low/zero TDS water for rinsing in steps 1610 and 1708 may eliminate the need for removing any excess fluid (step 1612) from the cleaning surface or window after cleaning. This is due to low/zero TDS water being able to air dry without leaving behind any streaking, residue, mineral deposits, or spotting on the surface. Thus, cleaning may be improved and steps eliminated by using low/zero TDS water to rinse a surface or window being cleaned.

While zero TDS water is preferable for use in the rinse bar to prevent spotting and mineral buildup in the device and to ensure the surfaces are left clean with low or no streaks and/or residue left behind after cleaning, the disclosure is not limited to using only this fluid. Any TDS level of water may be used or any other cleaning fluid suitable for rinsing and cleaning is to be understood to be within the scope of this disclosure.

Examples

The following examples pertain to further embodiments.

Example 1 is a cleaning device for cleaning surfaces. The cleaning device comprises a plate that holds a cleaning material, a rinse bar attached to the plate and disposed to extend along two or more edges of the plate; and one or more rinse inlet ports that are in fluid communication with the rinse bar. In the cleaning device a plurality of openings are formed in the rinse bar. A fluid supplied to the rinse bar is expelled out of the plurality of openings.

Example 2 is a cleaning device as in Example 1, wherein the rinse bar extends around the entire outer perimeter of the plate.

Example 3 is a cleaning device as in Examples 1-2, wherein the rinse bar is attached to the plate by a plurality of supporting brackets. In the cleaning device, one or more of the plurality of supporting brackets is in fluid communication with the rinse bar. One or more of the rinse inlet ports is connected to the one or more supporting brackets in fluid communication with the rinse bar and the one or more of the rinse inlet ports is in fluid communication with the rinse bar through the one or more supporting brackets.

Example 4 is a cleaning device as in Examples 1-3, further comprising a handle attached to a first surface of the plate.

Example 5 is a cleaning device as in Examples 1-4, wherein the handle comprises a connector that connects a pole to the cleaning device.

Example 6 is a cleaning device as in Examples 1-5, wherein the handle further comprises a first pivot that allows the plate to pivot with respect to the handle in a first direction, and a second pivot that allows the plate to pivot with respect to the handle in a second direction that is perpendicular to the first direction.

Example 7 is a cleaning device as in Examples 1-6, the handle further comprising one or more locking mechanisms for locking one or more of the first pivot and the second pivot to prevent rotation of the plate with respect to the handle in one or more of the first direction and the second direction.

Example 8 is a cleaning device as in Examples 1-7, further comprising one or more holes formed through the plate, and one or more fluid inlet ports connected to a first surface of the plate at positions adjacent to the one or more holes. The cleaning material is disposed on a second surface of the plate that is opposite to the first surface of the plate. The fluid supplied to the one or more fluid inlet ports passes through the plate and is expelled out of the holes to the second surface of the plate.

Example 9 is a cleaning device as in Examples 1-8, wherein the cleaning material is removably held to the plate such that a worn cleaning material may be removed from the plate and replaced with a new cleaning material.

Example 10 is a cleaning device as in Examples 1-9, wherein the one or more rinse inlet ports are removably connected to the rinse bar and the one or more fluid inlet ports are removably connected to the plate such that worn rinse inlet ports inlet and worn fluid inlet ports may be removed and replaced with new rinse inlet ports and new fluid inlet ports.

Example 11 is a cleaning device as in Examples 1-10, wherein the fluid supplied to the one or more rinse inlet ports is a first fluid and the fluid supplied to the one or more inlet ports is a second fluid different than the first fluid.

Example 12 is a cleaning system for cleaning surfaces. The cleaning system comprises a cleaning device comprising a plate that holds a cleaning material, a rinse bar attached to the plate and disposed to extend along two or more edges of the plate; and one or more rinse inlet ports that are in fluid communication with the rinse bar. The cleaning system further comprises a fluid-fed pole removably connected to the cleaning device, a fluid feed system that supplies fluid to the cleaning device, and rinse tubing that is removably connected to the one or more rinse inlet ports and that carries fluid from the fluid feed system to the one or more rinse inlet ports of the cleaning device. In the cleaning device a plurality of openings are formed in the rinse bar and a fluid supplied to the rinse bar is expelled out of the plurality of openings.

Example 13 is a cleaning system as in Example 12, wherein the rinse bar extends around the entire outer perimeter of the plate.

Example 14 is a cleaning system as in Examples 12-13, wherein the rinse bar is attached to the plate by a plurality of supporting brackets. In the cleaning device, one or more of the plurality of supporting brackets is in fluid communication with the rinse bar. One or more of the rinse inlet ports is connected to the one or more supporting brackets in fluid communication with the rinse bar and the one or more of the rinse inlet ports is in fluid communication with the rinse bar through the one or more supporting brackets.

Example 15 is a cleaning system as in Examples 12-14, further comprising a handle attached to a first surface of the plate.

Example 16 is a cleaning system as in Examples 12-15, wherein the handle comprises a connector that connects a pole to the cleaning device.

Example 17 is a cleaning system as in Examples 12-16, wherein the handle further comprises a first pivot that allows the plate to pivot with respect to the handle in a first direction, and a second pivot that allows the plate to pivot with respect to the handle in a second direction that is perpendicular to the first direction.

Example 18 is a cleaning device as in Examples 12-17, the handle further comprising one or more locking mechanisms for locking one or more of the first pivot and the second pivot to prevent rotation of the plate with respect to the handle in one or more of the first direction and the second direction.

Example 19 is a cleaning system as in Examples 12-18, further comprising one or more holes formed through the plate, and one or more fluid inlet ports connected to a first surface of the plate at positions adjacent to the one or more holes. The cleaning material is disposed on a second surface of the plate that is opposite to the first surface of the plate. The fluid supplied to the one or more fluid inlet ports passes through the plate and is expelled out of the holes to the second surface of the plate.

Example 20 is a cleaning system as in Examples 12-19, wherein the cleaning material is removably held to the plate such that a worn cleaning material may be removed from the plate and replaced with a new cleaning material.

Example 21 is a cleaning system as in Examples 12-20, wherein the one or more rinse inlet ports are removably connected to the rinse bar and the one or more fluid inlet ports are removably connected to the plate such that worn rinse inlet ports inlet and worn fluid inlet ports may be removed and replaced with new rinse inlet ports and new fluid inlet ports.

Example 22 is a cleaning system as in Examples 12-21, wherein the fluid supplied to the one or more rinse inlet ports is a first fluid and the fluid supplied to the one or more inlet ports is a second fluid different than the first fluid.

Example 23 is a method for cleaning a surface using a cleaning device comprising a plate that holds a cleaning material, a rinse bar attached to the plate and disposed to extend along two or more edges of the plate, and one or more rinse inlet ports that are in fluid communication with the rinse bar, wherein a plurality of openings are formed in the rinse bar and fluid supplied to the rinse bar is expelled out of the plurality of openings. The method comprises a step of feeding fluid to the rinse bar of the cleaning device, wherein the rinse bar surrounds a cleaning material disposed on the cleaning device. The method further comprises a step of rinsing the surface to be cleaned with a first fluid from the rinse bar.

Example 24 is the method as in Example 23, further comprising a step of spraying the surface to be cleaned with a second fluid through the cleaning device.

Example 25 is the method as in Examples 23-24, further comprising a step of scrubbing the sprayed surface with the cleaning material disposed on the cleaning device.

Example 26 is the method as in Examples 23-25, further comprising a step of rinsing the surface to be cleaned with a third fluid from the rinse bar.

Example 27 is the method as in Examples 23-26, wherein the third fluid is the same fluid as the first fluid.

Example 28 is the method as in Examples 23-27, wherein the third fluid is different from the first fluid.

Example 29 is the method as in Examples 23-28, further comprising a step of removing excess fluid from the cleaned surface.

It will be appreciated that various features disclosed herein provide significant advantages and advancements in the art. The following claims are exemplary of some of those features.

In the foregoing Detailed Description of the Disclosure, various features of the disclosure are grouped together in a single embodiment for the purpose of streamlining the disclosure. This method of disclosure is not to be interpreted as reflecting an intention that the claimed disclosure requires more features than are expressly recited in each claim. Rather, inventive aspects lie in less than all features of a single foregoing disclosed embodiment.

It is to be understood that any features of the above-described arrangements, examples, and embodiments may be combined in a single embodiment comprising a combination of features taken from any of the disclosed arrangements, examples, and embodiments.

It is to be understood that the above-described arrangements are only illustrative of the application of the principles of the disclosure. Numerous modifications and alternative arrangements may be devised by those skilled in the art without departing from the spirit and scope of the disclosure and the appended claims are intended to cover such modifications and arrangements.

Thus, while the disclosure has been shown in the drawings and described above with particularity and detail, it will be apparent to those of ordinary skill in the art that numerous modifications, including, but not limited to, variations in size, materials, shape, form, function and manner of operation, assembly and use may be made without departing from the principles and concepts set forth herein.

The foregoing description has been presented for the purposes of illustration and description. It is not intended to be exhaustive or to limit the disclosure to the precise form disclosed. Many modifications and variations are possible in light of the above teaching. Further, it should be noted that any or all the aforementioned alternate implementations may be used in any combination desired to form additional hybrid implementations of the disclosure.

Further, although specific implementations of the disclosure have been described and illustrated, the disclosure is not to be limited to the specific forms or arrangements of parts so described and illustrated. The scope of the disclosure is to be defined by the claims appended hereto, any future claims submitted here and in different applications, and their equivalents.

What is claimed is:

1. A cleaning device comprising:

a plate that holds a cleaning material;

a rinse bar attached to the plate and disposed to extend along two or more edges of the plate, the rinse bar comprising a tubular configuration defining an internal channel configured to receive a fluid therein;

at least one supporting bracket that attaches the rinse bar to the plate and is in direct fluid communication with the rinse bar; and at least one rinse inlet port in fluid communication with the rinse bar and configured to be fluidly connected to a fluid supply;

wherein one or more openings configured to allow passage of fluid from the internal channel of the rinse bar to an outside of the rinse bar are formed in the rinse bar, and wherein the rinse inlet port is connected to the supporting bracket and is in direct fluid communication with the rinse bar through the supporting bracket.

2. The cleaning device of claim 1, wherein the rinse bar extends around an entire outer perimeter of the plate.

3. The cleaning device of claim 1, further comprising: a handle attached to a first surface of the plate.

4. The cleaning device of claim 3, wherein the handle comprises:

a connector that connects the cleaning device to a pole.

5. The cleaning device of claim 4, wherein the handle further comprises:

a first pivot that allows the plate to pivot with respect to the handle in a first direction; and a second pivot that allows the plate to pivot with respect to the handle in a second direction that is perpendicular to the first direction.

6. The cleaning device of claim 5, wherein the first pivot and the second pivot of the handle are configured to be selectively locked to prevent rotation of the plate with respect to the handle in one or more of the first direction and the second direction.

7. The cleaning device of claim 1, further comprising: one or more holes formed through the plate; and one or more fluid inlet ports connected to a first surface of the plate at positions adjacent to the one or more holes; wherein the cleaning material is disposed on a second surface of the plate that is opposite to the first surface of the plate.

8. The cleaning device of claim 7, wherein the one or more rinse inlet ports and the one or more fluid inlet ports are removably connected to the plate such that worn rinse inlet ports and worn fluid inlet ports may be removed and replaced with new rinse inlet ports and new fluid inlet ports.

9. The cleaning device of claim 7, wherein the one or more rinse inlet ports are supplied with a first fluid and the one or more fluid inlet ports are supplied with a second fluid different than the first fluid.

* * * * *